US009427985B2

(12) United States Patent
Taniguchi et al.

(10) Patent No.: US 9,427,985 B2
(45) Date of Patent: Aug. 30, 2016

(54) PRINTING APPARATUS, CONTROL METHOD FOR PRINTING APPARATUS, AND STORAGE MEDIUM

(71) Applicant: CANON KABUSHIKI KAISHA, Tokyo (JP)

(72) Inventors: Hisashi Taniguchi, Yokohama (JP); Tetsuya Saito, Yokohama (JP); Syunichi Kunihiro, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/723,617

(22) Filed: May 28, 2015

(65) Prior Publication Data

US 2015/0352865 A1 Dec. 10, 2015

(30) Foreign Application Priority Data

Jun. 4, 2014 (JP) ..... 2014-116204

(51) Int. Cl.
*B41J 3/60* (2006.01)
*B41J 13/00* (2006.01)

(52) U.S. Cl.
CPC ..... *B41J 13/0009* (2013.01); *B41J 3/60* (2013.01); *B41J 13/0018* (2013.01)

(58) Field of Classification Search
CPC ..... B41J 13/0009–13/0045; B41J 11/005; B41J 3/60
USPC ..... 347/16
See application file for complete search history.

(56) References Cited

U.S. PATENT DOCUMENTS 4,693,587 A 9/1987 Shigenobu et al.
5,915,684 A 6/1999 Nakagawa et al.
6,848,848 B2 * 2/2005 Terao ..... B41J 13/0018 400/624
2007/0147921 A1 * 6/2007 Chae ..... G03G 15/234 399/401

FOREIGN PATENT DOCUMENTS

JP 2001-324844 A 11/2001

OTHER PUBLICATIONS

Copending, unpublished U.S. Appl. No. 14/715,810 to Tetsuya Saito et al., dated May 19, 2015.
Copending, unpublished U.S. Appl. No. 14/623,860 to Tomofumi Nishida et al., dated Feb. 17, 2015.
Copending, unpublished U.S. Appl. No. 14/722,379 to Tomofumi Nishida et al., dated May 27, 2015.
(Continued)

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

A printing apparatus includes a feeding unit configured to feed a printing sheet stacked on a stacking unit, a conveying unit configured to convey the printing sheet fed by the feeding unit, a printing unit configured to print the printing sheet conveyed by the conveying unit, and a control unit configured to control the feeding unit and the conveying unit. When continuously printing on the first surfaces of a plurality of printing sheets, the feeding unit forms an overlap state in which a trailing edge of a preceding sheet and a leading edge of a succeeding sheet overlap each other, and the conveying unit conveys the printing sheets while keeping the overlap state. When performing double-sided printing on the first surface and the second surface of the printing sheet, the feeding unit does not form the overlap state.

7 Claims, 18 Drawing Sheets

(56) References Cited

OTHER PUBLICATIONS

Copending, unpublished U.S. Appl. No. 14/722,324 to Motoyuki Taguchi et al., dated May 27, 2015.

Copending, unpublished U.S. Appl. No. 14/743,039 to Katsuya Ogawa et al., dated Jun. 18, 2015.

Copending, unpublished U.S. Appl. No. 14/729,324 to Syunichi Kunihiro et al., dated Jun. 3, 2015.

* cited by examiner

PRINTING APPARATUS, CONTROL METHOD FOR PRINTING APPARATUS, AND STORAGE MEDIUM

BACKGROUND OF THE INVENTION

1. Field of the Invention

The present invention relates to a printing apparatus for printing a sheet by a printhead and, more particularly, to a printing technique of conveying sheets to a printing area facing a printhead while part of a succeeding sheet overlaps part of a preceding sheet.

2. Description of the Related Art

In recent years, a printing apparatus is expected to increase the speed of printing to improve the productivity. As one of methods of increasing the speed, an interval between printing sheets to be successively fed is shortened. As a technique of shortening the interval between printing sheets, in addition to a method of simply shortening the interval between printing sheets, Japanese Patent Laid-Open No. 2001-324844 proposes a method of conveying sheets by making the marginal area of the leading edge of the succeeding sheet overlap the marginal area of the trailing edge of the preceding sheet, and forming images while the sheets overlap each other. This is a technique of forming images by excluding unnecessary portions (the interval between sheets and the marginal portion of each sheet) except for image forming areas.

However, if an inkjet printing apparatus executes high-density printing on an area where sheets overlap each other using a large amount of ink, wavy wrinkles called cockling can occur on the printing sheet due to moisture of the ink. When, therefore, cockling occurs, the printing sheet may unwantedly float, and graze against the printhead, thereby causing a stain on the printing sheet, or disabling conveyance to a discharge unit such as a discharge roller to cause a paper jam. In addition, when the distance between the printhead and the first surface of the sheet becomes unstable, an ink landing position may shift to degrade the image quality. Particularly, at the time of printing the second surface in double-sided printing, ink has been applied to the entire area of the sheet in printing of the first surface, and thus the printing sheet may largely float.

The present invention has been made in consideration of the above-described problem, and provides a printing technique capable of increasing the speed of a printing operation by implementing successive overlapped conveyance of sheets without causing a stain on the sheet, a paper jam, or the like, or degrading the image quality at the time of double-sided printing.

SUMMARY OF THE INVENTION

According to one aspect of the present invention, there is provided a printing apparatus comprising: a feeding unit configured to feed a printing sheet stacked on a stacking unit; a conveying unit configured to convey the printing sheet fed by the feeding unit; a printing unit configured to print the printing sheet conveyed by the conveying unit; and a control unit configured to control the feeding unit and the conveying unit, wherein when continuously printing on first surfaces of a plurality of printing sheets, the feeding unit forms an overlap state in which a trailing edge of a preceding sheet and a leading edge of a succeeding sheet overlap each other, and the conveying unit conveys the printing sheets while keeping the overlap state, and when performing double-sided printing on a first surface and a second surface of the printing sheet, the feeding unit does not form the overlap state.

According to another aspect of the present invention, there is provided a printing apparatus comprising: a feeding unit configured to feed a printing sheet stacked on a stacking unit; a conveying unit configured to convey the printing sheet fed by the feeding unit; a printing unit configured to print the printing sheet conveyed by the conveying unit; and a control unit configured to control the feeding unit and the conveying unit, wherein when continuously printing on first surfaces of a plurality of printing sheets, the control unit controls to form an overlap state in which a trailing edge of a preceding sheet and a leading edge of a succeeding sheet overlap each other, and when performing double-sided printing on a first surface and a second surface of the printing sheet, the control unit does not control to form the overlap state.

According to still another aspect of the present invention, there is provided a control method for a printing apparatus including a feeding unit configured to feed a printing sheet stacked on a stacking unit, a conveying unit configured to convey the printing sheet fed by the feeding unit, and a printing unit configured to print the printing sheet conveyed by the conveying unit, the method comprising: a control step of controlling the feeding unit and the conveying unit so that the feeding unit forms an overlap state in which a trailing edge of a preceding sheet and a leading edge of a succeeding sheet overlap each other and the conveying unit conveys the printing sheets while keeping the overlap state when continuously printing on first surfaces of a plurality of printing sheets, and the feeding unit does not form the overlap state when performing double-sided printing on a first surface and a second surface of the printing sheet.

According to the present invention, it is possible to provide a printing technique capable of increasing the speed of a printing operation by implementing successive overlapped conveyance of printing sheets without causing a stain on the printing sheet, a paper jam, or the like, or degrading the image quality at the time of double-sided printing.

Further features of the present invention will become apparent from the following description of exemplary embodiments (with reference to the attached drawings).

DESCRIPTION OF THE EMBODIMENTS

An embodiment of the present invention will be described in detail below with reference to the accompanying drawings.

Figure 1:
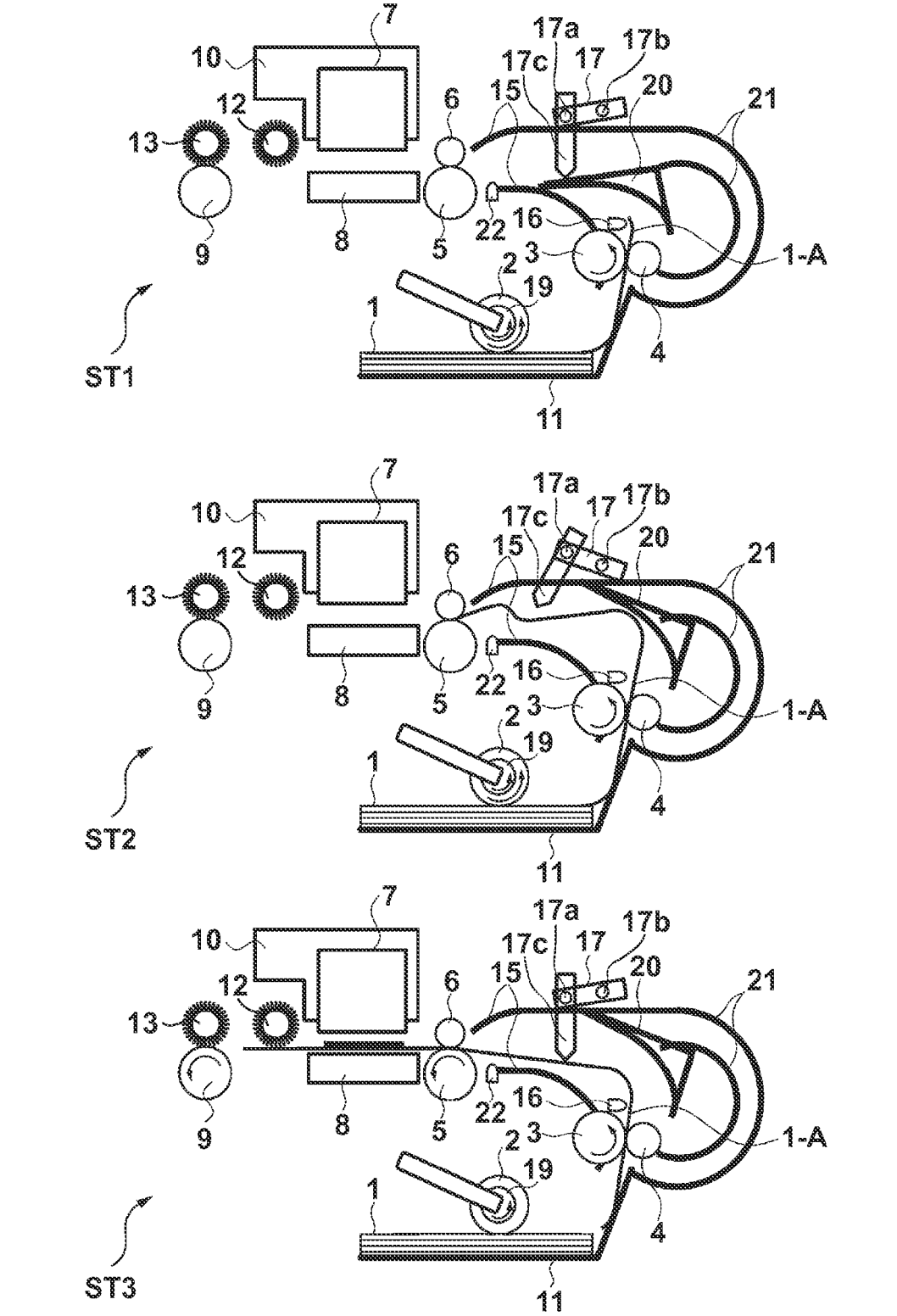
FIG. 1 is a view for explaining a successive overlapped conveyance operation in a printing apparatus according to an embodiment of the present invention.
Figure 2:
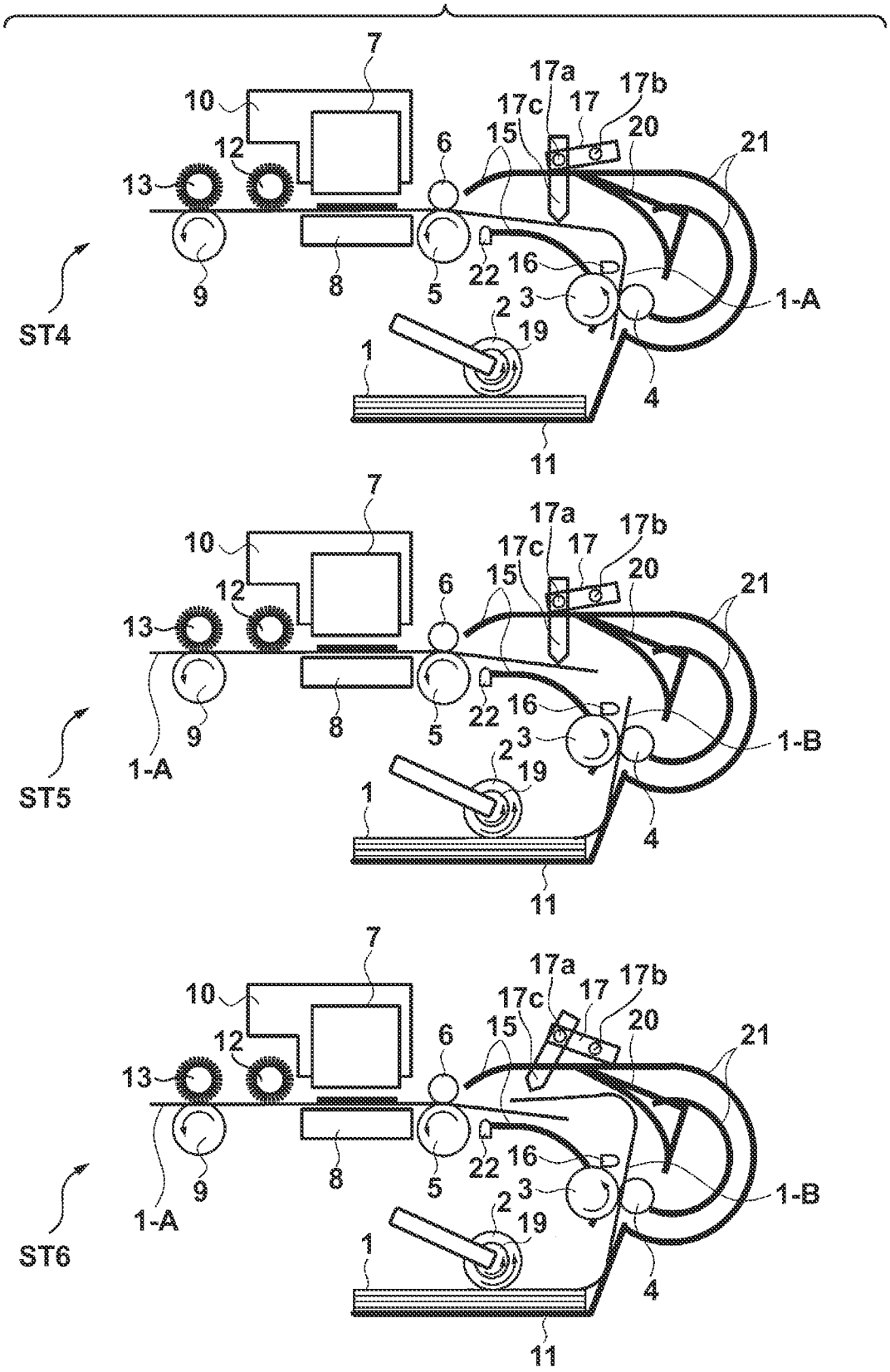
FIG. 2 is a view for explaining the successive overlapped conveyance operation in the printing apparatus according to the embodiment of the present invention.
Figure 3:
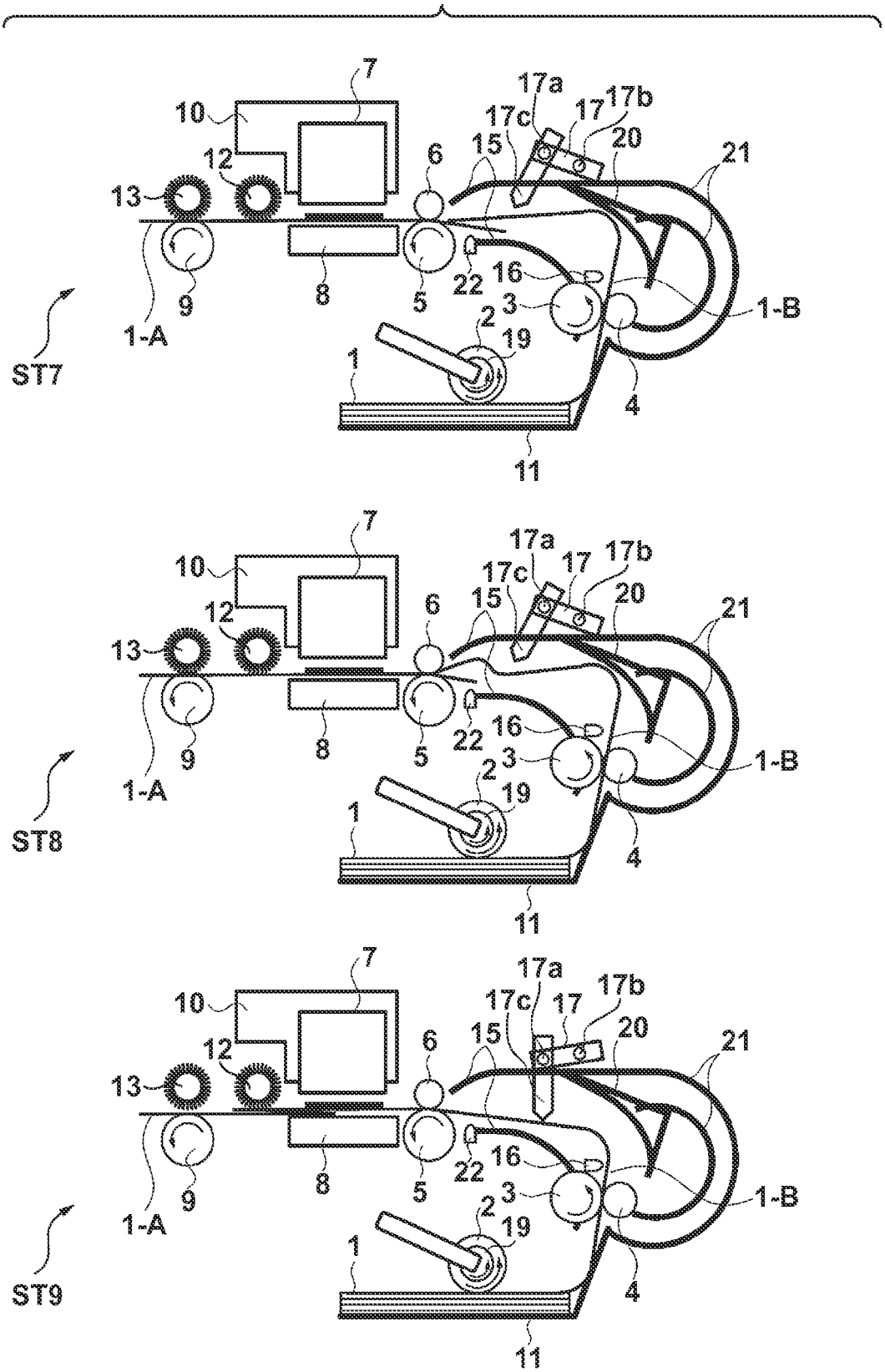
FIG. 3 is a view for explaining the successive overlapped conveyance operation in the printing apparatus according to the embodiment of the present invention.

FIGS. 1 to 3 are sectional views for explaining a successive overlapped conveyance operation in a printing apparatus according to the embodiment of the present invention. The schematic arrangement of the printing apparatus according to the embodiment will first be described with reference to ST1 of FIG. 1. The printing apparatus according to the embodiment can print on both the first and second surfaces of a printing sheet.

In ST1 of FIG. 1, reference numeral 1 denotes printing sheets. The plurality of printing sheets 1 are stacked on a feeding tray 11 (a stacking unit). A pickup roller 2 abuts against the top printing sheet 1 stacked on the feeding tray 11 to pick it up. A feeding roller 3 feeds the printing sheet 1 picked up by the pickup roller 2 toward the downstream side of a sheet conveyance direction. A feeding driven roller 4 is biased against the feeding roller 3 to sandwich the printing sheet 1 with the feeding roller 3, thereby feeding the printing sheet 1.

A conveyance roller 5 conveys the printing sheet 1 fed by the feeding roller 3 and feeding driven roller 4 to a position facing a printhead 7. A pinch roller 6 is biased against the conveyance roller 5 to sandwich the printing sheet with the conveyance roller 5, thereby conveying the printing sheet.

The printhead 7 prints the printing sheet 1 conveyed by the conveyance roller 5 and pinch roller 6. In this embodiment, an inkjet printhead which prints the printing sheet 1 by discharging ink from the printhead will be exemplified. A platen 8 supports the reverse surface of the printing sheet 1 at the position facing the printhead 7. A carriage 10 mounts the printhead 7 and moves in a direction intersecting the sheet conveyance direction.

A discharge roller 9 discharges the printing sheet printed by the printhead 7 to the outside of the apparatus. Spurs 12 and 13 rotate while they are in contact with the printing surface of the printing sheet printed by the printhead 7. The spur 13 on the downstream side is biased against the discharge roller 9, and no discharge roller 9 is arranged at a position facing the spur 12 on the upstream side. The spur 12 is used to prevent the floating of the printing sheet 1, and is also referred to as a pressing spur.

A conveyance guide 15 and a flapper 20 guide the printing sheet 1 between a feeding nip portion formed by the feeding roller 3 and feeding driven roller 4 and a conveyance nip portion formed by the conveyance roller 5 and pinch roller 6. The flapper 20 is pivotable by the reaction force of the printing sheet 1 conveyed by the feeding roller 3. A sheet detection sensor 16 detects the leading edge and trailing edge of the printing sheet 1. The sheet detection sensor 16 is provided downstream of the feeding roller 3 in the sheet conveyance direction. A sheet pressing lever 17 makes the leading edge of the succeeding sheet overlap the trailing edge of the preceding sheet. The sheet pressing lever 17 is biased by an elastic member (for example, a spring) around a rotating shaft 17*b* in a counterclockwise direction by setting the state shown in ST1 of FIG. 1 as a neutral point. A distal end 17*c* of the sheet pressing lever 17 which is in contact with the printing sheet 1 is biased by the elastic member (for example, the spring) around a point 17*a* in a clockwise direction in FIG. 1. A sheet detection sensor 22 (second sheet detection sensor) detects the leading edge and trailing edge of the printing sheet 1. The sheet detection sensor 22 (second sheet detection sensor) detects the timing at which the leading edge of the printing sheet 1 enters the conveyance nip portion formed by the conveyance roller 5 and pinch roller 6, and the timing at which the trailing edge of the printing sheet 1 currently undergoing a printing operation passes through the conveyance nip portion. A reverse conveyance guide 21 is used for a reversing unit for reversing the printing sheet 1, and guides, to the feeding nip portion formed by the feeding roller 3 and feeding driven roller 4, the printing sheet 1 conveyed in a backward direction by the conveyance roller 5.

Figure 4A:
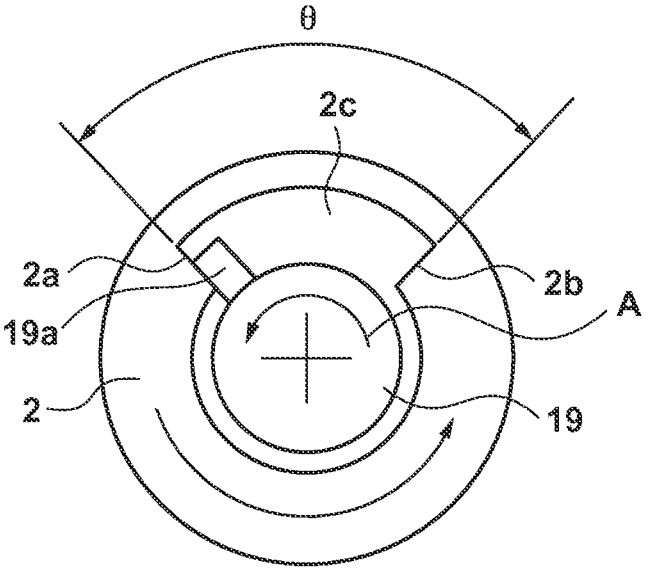
FIGS. 4A and 4B are views for explaining the arrangement of a pickup roller.
Figure 4B:
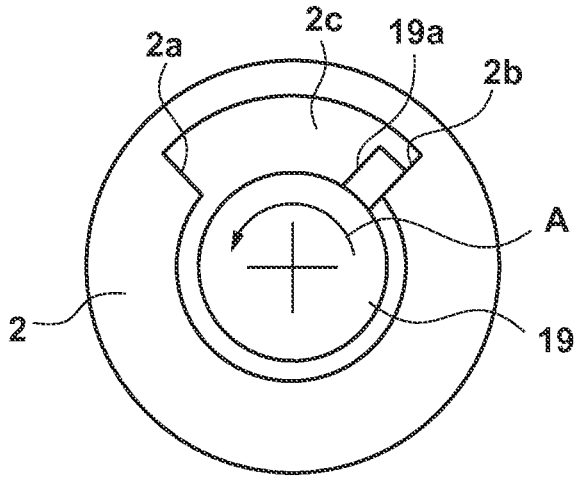

FIGS. 4A and 4B are views for explaining the arrangement of the pickup roller 2. As described above, the pickup roller 2 abuts against the top printing sheet stacked on the feeding tray 11 to pick it up. A driving shaft 19 transmits driving of a feeding motor (to be described later) to the pickup roller 2. When picking up the printing sheet, the driving shaft 19 and the pickup roller 2 rotate in a direction indicated by an arrow A in FIGS. 4A and 4B. A projection 19*a* is formed in the driving shaft 19. A concave portion 2*c* in which the projection 19*a* fits is formed in the pickup roller 2. As shown in FIG. 4A, when the projection 19*a* abuts against a first surface 2*a* of the concave portion 2*c* of the pickup roller 2, driving of the driving shaft 19 is transmitted to the pickup roller 2. In this case, when the driving shaft 19 is driven, the pickup roller 2 is also rotated. On the other hand, as shown in FIG. 4B, when the projection 19*a* abuts against a second surface 2*b* of the concave portion 2*c* of the pickup roller 2, driving of the driving shaft 19 is not transmitted to the pickup roller 2. In this case, even if the driving shaft 19 is driven, the pickup roller 2 is not rotated. Also, when the projection 19*a* is formed between the first surface 2*a* and the second surface 2*b* without abutting against the first surface 2*a* or the second surface 2*b*, even if the driving shaft 19 is driven, the pickup roller 2 is not rotated.

Figure 5:
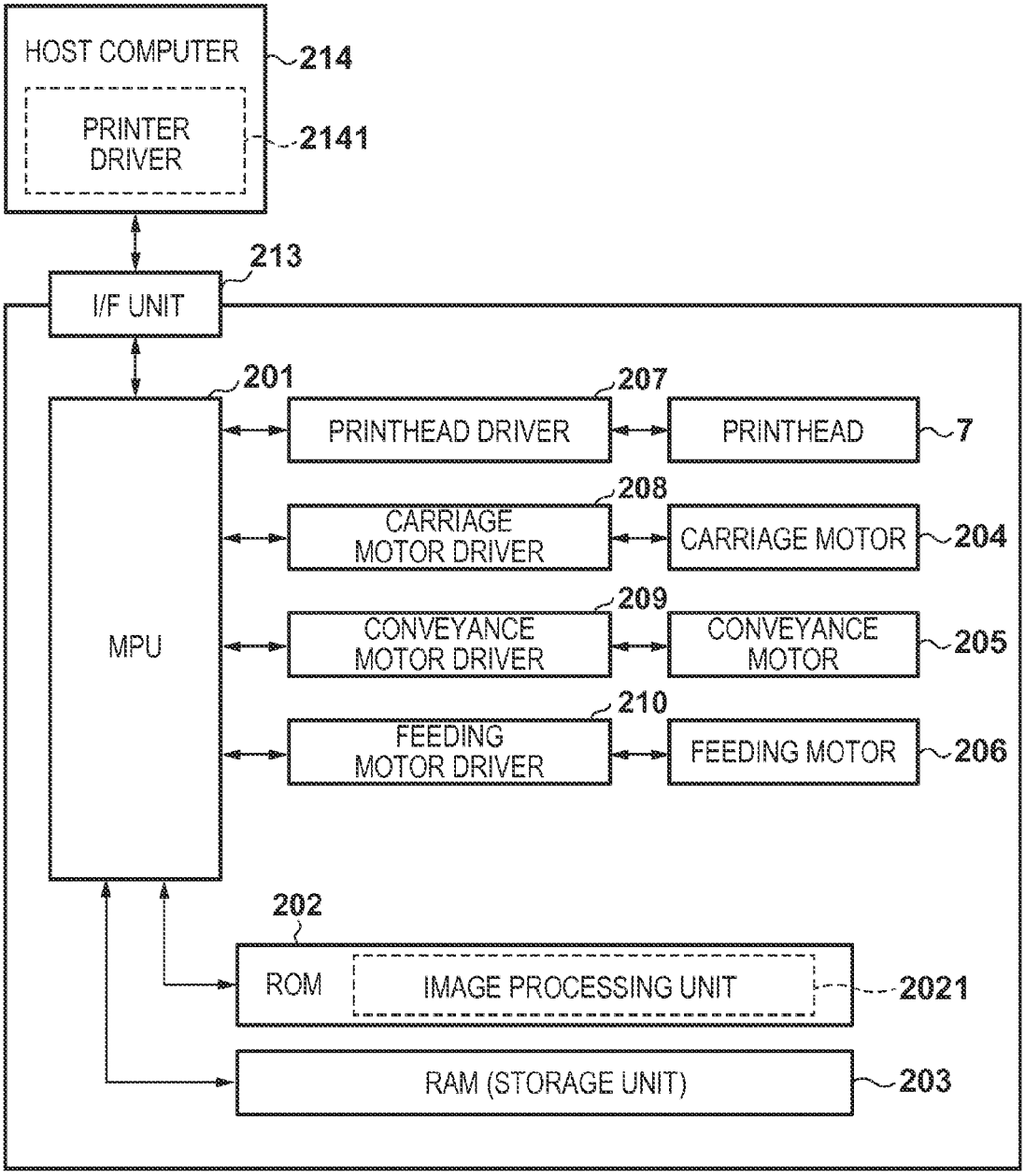
FIG. 5 is a block diagram showing the printing apparatus according to the embodiment.

FIG. 5 is a block diagram showing the printing apparatus according to this embodiment. An MPU 201 controls the operation of each unit, data processing, and the like. As will be described later, the MPU 201 also functions as a conveyance control unit capable of controlling conveyance of the printing sheets so that the trailing edge of a preceding sheet and the leading edge of a succeeding sheet overlap each other. A ROM 202 stores data and programs to be executed by the MPU 201. A RAM 203 temporarily stores processing data to be executed by the MPU 201 and data received from a host computer 214. When continuously printing on the first surfaces of the plurality of printing sheets, the MPU 201 controls to form an overlap state in which the leading edge of the succeeding sheet overlaps the trailing edge of the preceding sheet. Alternatively, when performing double-sided printing on the first and second surfaces of the printing sheet, the MPU 201 does not control to form the overlap state.

A printhead driver 207 controls the printhead 7. A carriage motor driver 208 controls a carriage motor 204 for driving the carriage 10. A conveyance motor 205 drives the conveyance roller 5 and discharge roller 9. A conveyance motor driver 209 controls the conveyance motor 205. A feeding motor 206 drives the pickup roller 2 and feeding roller 3. A feeding motor driver 210 controls the feeding motor 206.

In the host computer 214, a printer driver 2141 is used to communicate with the printing apparatus by collecting printing information such as a printing image and printing image quality when the user instructs the execution of a printing operation. The MPU 201 exchanges the printing image and the like with the host computer 214 via an I/F unit 213.

The successive overlapped conveyance operation in continuous printing of only the first surfaces of the printing sheets 1 will be described in time series with reference to ST1 of FIG. 1 to ST9 of FIG. 3. When the host computer 214 transmits printing data via the I/F unit 213, the printing data is processed by the MPU 201, and then loaded into the RAM 203. The MPU 201 starts a printing operation based on the loaded data.

A description will be provided with reference to ST1 of FIG. 1. The feeding motor driver 210 drives the feeding motor 206 at low speed. This rotates the pickup roller 2 at 7.6 inches/sec. When the pickup roller 2 rotates, the top printing sheet (a preceding sheet 1-A) stacked on the feeding tray 11 is picked up. The preceding sheet 1-A picked up by the pickup roller 2 is conveyed by the feeding roller 3 rotating in the same direction as that of the pickup roller 2. The feeding motor 206 also drives the feeding roller 3. This embodiment will be described by using an arrangement including the pickup roller 2 and the feeding roller 3. However, an arrangement including only a feeding roller for feeding the printing sheet stacked on the stacking unit may be adopted.

When the sheet detection sensor 16 provided on the downstream side of the feeding roller 3 detects the leading edge of the preceding sheet 1-A, the feeding motor 206 is switched to high-speed driving. That is, the pickup roller 2 and feeding roller 3 rotate at 20 inches/sec.

A description will be provided with reference to ST2 of FIG. 1. When the feeding roller 3 is continuously rotated, the leading edge of the preceding sheet 1-A pushes the flapper 20 away against its own weight, and also rotates the sheet pressing lever 17 about the rotating shaft 17*b* in the clockwise direction against the biasing force of the spring. When the feeding roller 3 is further continuously rotated, the leading edge of the preceding sheet 1-A abuts against the conveyance nip portion formed by the conveyance roller 5 and pinch roller 6. At this time, the conveyance roller 5 stops. By rotating the feeding roller 3 by a predetermined amount even after the leading edge of the preceding sheet 1-A abuts against the conveyance nip portion, alignment of the preceding sheet 1-A is performed to correct the skew while the leading edge of the preceding sheet 1-A abuts against the conveyance nip portion. The skew correction operation will also be referred to as a registration adjustment operation.

A description will be provided with reference to ST3 of FIG. 1. Upon end of the skew correction operation of the preceding sheet 1-A, the conveyance motor 205 is driven to start rotation of the conveyance roller 5. The conveyance roller 5 conveys the sheet at 15 inches/sec. After the preceding sheet 1-A is aligned with the position facing the printhead 7, a printing operation is performed by discharging ink from the printhead 7 based on the printing data. Note that the alignment operation is performed by making the leading edge of the printing sheet abut against the conveyance nip portion to temporarily position the printing sheet at the position of the conveyance roller 5, and controlling the rotation amount of the conveyance roller 5 with reference to the position of the conveyance roller 5.

The printing apparatus of this embodiment is a serial type printing apparatus in which the carriage 10 mounts the printhead 7. A conveyance operation of intermittently conveying the printing sheet by a predetermined amount using the conveyance roller 5 and an image forming operation of discharging ink from the printhead 7 while moving the carriage 10 incorporating the printhead 7 when the conveyance roller 5 stops are repeated. By repeating the conveyance operation and the image forming operation, the printing operation of the printing sheet is performed.

When alignment of the preceding sheet 1-A is performed, the feeding motor 206 is switched to low-speed driving. That is, the pickup roller 2 and feeding roller 3 rotate at 7.6 inches/sec. While the conveyance roller 5 intermittently conveys the printing sheet by the predetermined amount, the feeding motor 206 also intermittently drives the feeding roller 3. That is, while the conveyance roller 5 rotates, the feeding roller 3 also rotates. While the conveyance roller 5 stops, the feeding roller 3 also stops. The rotation speed of the feeding roller 3 is lower than that of the conveyance roller 5. Consequently, the sheet is stretched between the conveyance roller 5 and the feeding roller 3. The feeding roller 3 is rotated together with the printing sheet conveyed by the conveyance roller 5.

Since the feeding motor 206 is intermittently driven, the driving shaft 19 is also driven. As described above, the rotation speed of the pickup roller 2 is lower than that of the conveyance roller 5. Consequently, the pickup roller 2 is rotated together with the printing sheet conveyed by the conveyance roller 5. That is, the pickup roller 2 rotates ahead of the driving shaft 19. More specifically, the projection 19*a* of the driving shaft 19 is spaced apart from the first surface 2*a* and abuts against the second surface 2*b*. Therefore, the second printing sheet (a succeeding sheet 1-B) is not picked up soon after the trailing edge of the preceding sheet 1-A passes through the pickup roller 2. After the driving shaft 19 is driven for a predetermined time, the projection 19*a* abuts against the first surface 2*a* and the pickup roller 2 starts to rotate.

A description will be provided with reference to ST4 of FIG. 2. In ST4, a state in which the pickup roller 2 starts to rotate, and picks up the succeeding sheet 1-B is shown. Due to a factor such as the responsiveness of the sensor, the sheet detection sensor 16 requires a predetermined interval or more between the printing sheets to detect the edges of the printing sheets. That is, it is necessary to separate the leading edge of the succeeding sheet 1-B from the trailing edge of the preceding sheet 1-A by a predetermined distance to provide a predetermined time interval from when the sheet detection sensor 16 detects the trailing edge of the preceding sheet 1-A until it detects the leading edge of the succeeding sheet 1-B. To achieve this, the angle of the concave portion 2*c* of the pickup roller 2 is set to about 70°.

A description will be provided with reference to ST5 of FIG. 2. The succeeding sheet 1-B picked up by the pickup roller 2 is conveyed by the feeding roller 3. At this time, the preceding sheet 1-A undergoes an image forming operation by the printhead 7 based on the printing data. When the sheet detection sensor 16 detects the leading edge of the succeeding sheet 1-B, the feeding motor 206 is switched to high-speed driving. That is, the pickup roller 2 and feeding roller 3 rotate at 20 inches/sec.

A description will be provided with reference to ST6 of FIG. 2. The distal end 17*c* of the sheet pressing layer 17 presses the trailing edge of the preceding sheet 1-A downward, as shown in ST5 of FIG. 2. It is possible to form a state in which the leading edge of the succeeding sheet 1-B overlaps the trailing edge of the preceding sheet 1-A by moving the succeeding sheet 1-B at a speed higher than that at which the preceding sheet 1-A moves downstream by the printing operation of the printhead 7 (ST6 of FIG. 2). Since the preceding sheet 1-A undergoes the printing operation based on the printing data, it is intermittently conveyed by the conveyance roller 5. On the other hand, after the sheet detection sensor 16 detects the leading edge of the succeeding sheet 1-B, the succeeding sheet 1-B can catch up with the preceding sheet 1-A by continuously rotating the feeding roller 3 at 20 inches/sec.

A description will be provided with reference to ST7 of FIG. 3. After forming an overlap state in which the leading edge of the succeeding sheet 1-B overlaps the trailing edge of the preceding sheet 1-A, the succeeding sheet 1-B is conveyed by the feeding roller 3 until the leading edge of the succeeding sheet 1-B stops at a predetermined position upstream of the conveyance nip portion. The position of the leading edge of the succeeding sheet 1-B is calculated from the rotation amount of the feeding roller 3 after the sheet detection sensor 16 detects the leading edge of the succeeding sheet 1-B, and controlled based on the calculation result. At this time, the preceding sheet 1-A undergoes an image forming operation by the printhead 7 based on the printing data.

A description will be provided with reference to ST8 of FIG. 3. When the conveyance roller 5 stops to perform the image forming operation (ink discharge operation) of the last row of the preceding sheet 1-A, the feeding roller 3 is driven to make the leading edge of the succeeding sheet 1-B abut against the conveyance nip portion, thereby performing the skew correction operation of the succeeding sheet 1-B.

A description will be provided with reference to ST9 of FIG. 3. When the image forming operation of the last row of the preceding sheet 1-A ends, it is possible to perform alignment of the succeeding sheet 1-B while keeping the state in which the succeeding sheet 1-B overlaps the preceding sheet 1-A by rotating the conveyance roller 5 by a predetermined amount. The succeeding sheet 1-B undergoes a printing operation by the printhead 7 based on the printing data. When the succeeding sheet 1-B is intermittently conveyed for the printing operation, the preceding sheet 1-A is also intermittently conveyed, and is finally discharged outside the printing apparatus by the discharge roller 9.

When alignment of the succeeding sheet 1-B is performed, the feeding motor 206 is switched to low-speed driving. That is, the pickup roller 2 and feeding roller 3 rotate at 7.6 inches/sec. If there is printing data even after the succeeding sheet 1-B, the process returns to ST4 of FIG. 2 to pick up the third printing sheet.

A reversing operation at the time of double-sided printing will be described in time series with reference to ST11 of FIG. 11 to ST16 of FIG. 12. Note that an operation of printing the first surface at the time of double-sided printing is the same as that in ST1 to ST3 of FIG. 1 described above and a description thereof will be omitted.

When executing double-sided printing, the MPU 201 controls to reverse the printing surface of the printing sheet (sheet 1-A) from the first surface to the second surface after completion of the printing operation of the first surface of the sheet 1-A. The MPU 201 conveys the printing sheet from the side of the conveyance roller 5 to the side of the feeding roller 3 in a direction opposite to the conveyance direction at the time of the printing operation via the sheet pressing lever 17 and the reverse conveyance guide 21. The reverse conveyance guide 21 reverses the sheet 1-A from the first surface to the second surface, and sets the second surface of the sheet 1-A as a printing surface. The MPU 201 conveys the reversed sheet 1-A from the side of the feeding roller 3 to the side of the conveyance roller 5.

Practical processing at the time of the reversing operation will be described below with reference to FIGS. 11 and 12. In ST11 of FIG. 11, when the printing operation of the sheet 1-A ends, the conveyance roller 5 and discharge roller 9 stop rotating. The discharge roller 9 rotates until the trailing edge of the sheet 1-A is set at a position a distance LA away from the conveyance nip portion formed by the conveyance roller 5 and pinch roller 6, and the discharge roller 9 and spur 13 hold the sheet 1-A which has passed through the conveyance nip portion. At this time, the flapper 20 is at a lower position by its own weight, as shown in ST11 of FIG. 11, and guides the sheet 1-A to the reverse conveyance guide 21.

Figure 11:
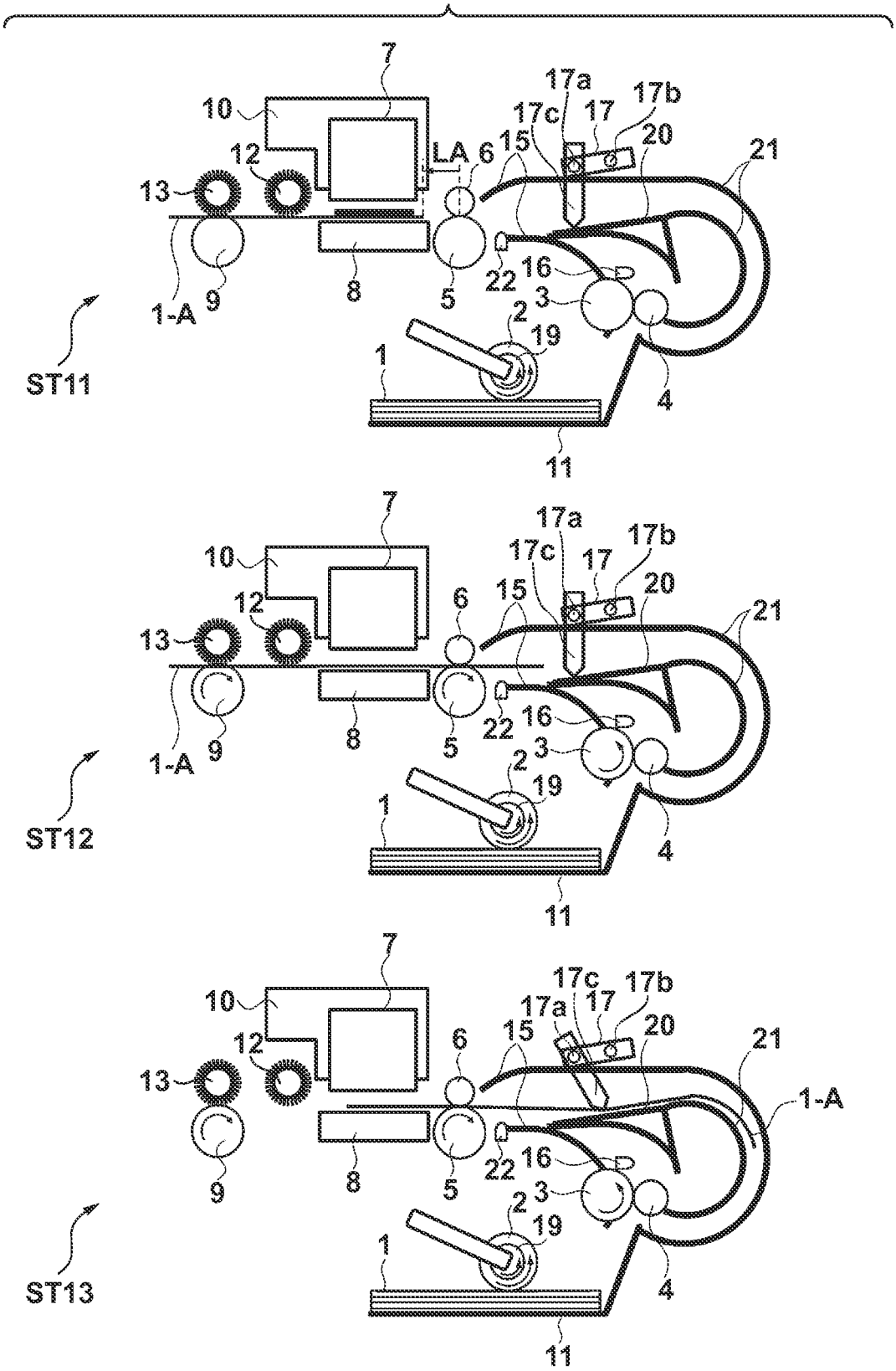
FIG. 11 is a view for explaining a reversing operation at the time of double-sided printing in the printing apparatus according to the embodiment.

A description will be provided with reference to ST12 of FIG. 11. The conveyance roller 5 and discharge roller 9 reversely rotate in a direction (the clockwise direction in FIG. 11) opposite to that at the time of the printing operation to cause the sheet 1-A to re-enter the conveyance nip portion of the conveyance roller 5 and pinch roller 6, thereby conveying the sheet 1-A toward the conveyance guide 15 and sheet pressing lever 17. At this time, the conveyance roller 5 rotates at 8 inches/sec. When the conveyance roller 5 and discharge roller 9 start to reversely rotate, the feeding roller 3 also forwardly rotates (in the counterclockwise direction in ST12 of FIG. 11). The feeding roller 3 rotates at 8 inches/sec.

A description will be provided with reference to ST13 of FIG. 11. When the conveyance roller 5 continuously rotates in the clockwise direction in FIG. 11, one edge (the trailing edge at the time of printing the first surface) of the sheet 1-A rotates the distal end 17*c* of the sheet pressing lever 17 in the counterclockwise direction against the biasing force of the spring. The sheet pressing lever 17 is configured to be rotatable while it is in contact with the sheet 1-A when the sheet 1-A is conveyed in the conveyance direction at the time of the reversing operation. Note that the sheet pressing lever 17 can be arranged at a position which does not contact the sheet 1-A when the printing sheet is conveyed in the conveyance direction at the time of the reversing operation. The sheet pressing lever 17 may be configured so that the one edge of the sheet 1-A passes through the sheet pressing lever 17 without contacting the lower position of the distal end 17*c* of the sheet pressing lever 17. When the conveyance roller 5 further continuously rotates in the clockwise direction in FIG. 11, one edge of the sheet 1-A is guided to the reverse conveyance guide 21.

Figure 12:
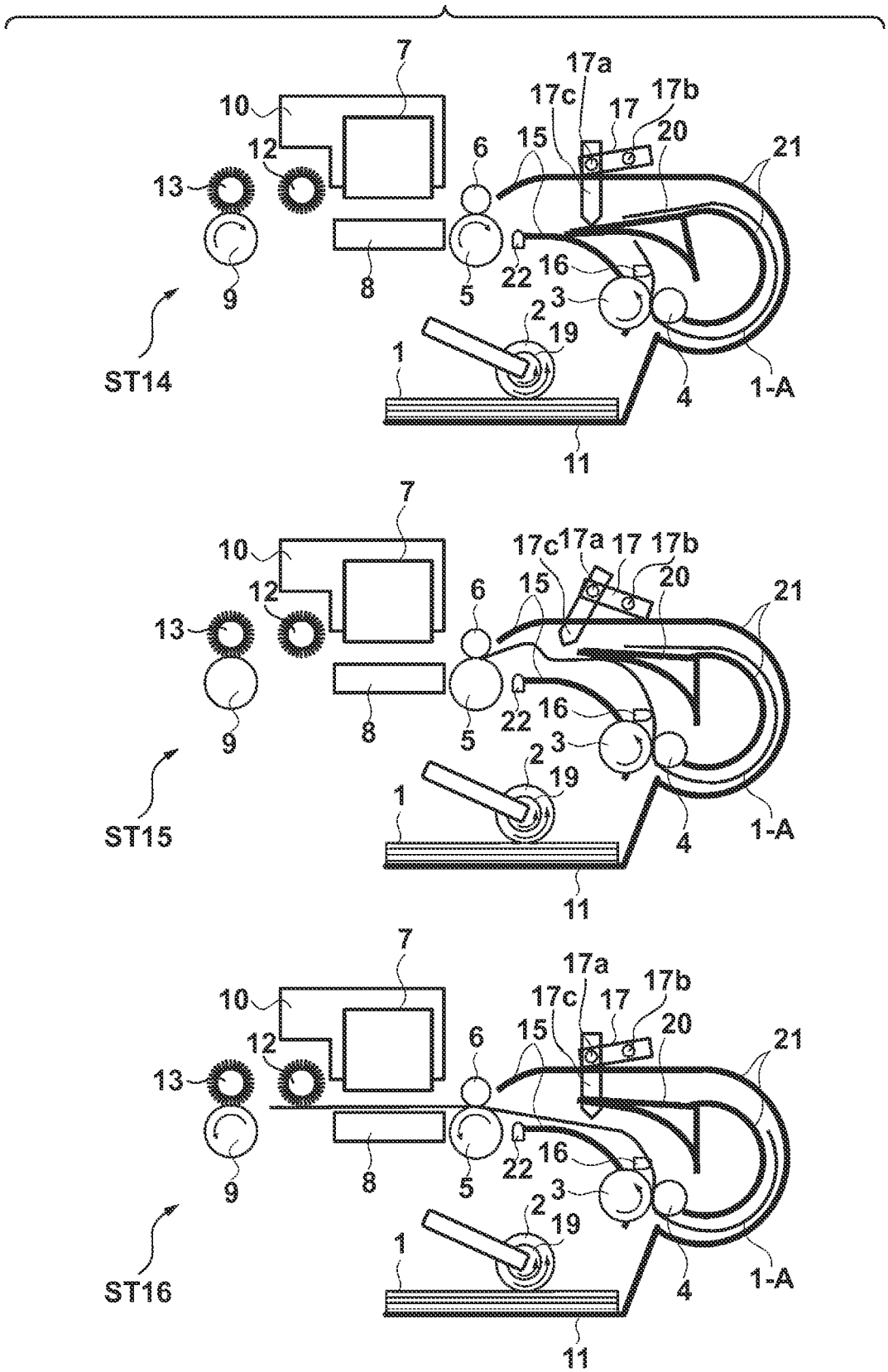
FIG. 12 is a view for explaining the reversing operation at the time of double-sided printing in the printing apparatus according to the embodiment.

A description will be provided with reference to ST14 of FIG. 12. When the conveyance roller 5 further continuously rotates in the clockwise direction in FIG. 12, one edge (the trailing edge at the time of printing the first surface) of the sheet 1-A is guided to the reverse conveyance guide 21, and enters the feeding nip portion formed by the feeding roller 3 and feeding driven roller 4. When the sheet detection sensor 16 detects one edge of the sheet 1-A, the conveyance roller 5 rotates by a predetermined amount, and then the conveyance roller 5 and feeding roller 3 temporarily stop rotating. In this arrangement, when the sheet 1-A reaches a position at which the sheet detection sensor 16 detects one edge of sheet 1-A, the other edge of the sheet 1-A passes through the distal end 17*c* of the sheet pressing lever 17.

A description will be provided with reference to ST15 of FIG. 12. By continuously rotating (forwardly rotating) the feeding roller 3, one edge of the sheet 1-A pushes the flapper 20 away against its own weight and the reaction force of the sheet 1-A, and meets the conveyance guide 15 again. At this time, since the other edge of the sheet 1-A has passed through the sheet pressing lever 17, the reaction force of the sheet 1-A when one edge of the sheet 1-A pushes the flapper 20 away can be minimized. When the feeding roller 3 is further continuously rotated, one edge of the sheet 1-A abuts against the conveyance nip portion formed by the conveyance roller 5 and pinch roller 6 to perform skew correction, as in ST2.

A description will be provided with reference to ST16 of FIG. 12. Upon end of the skew correction operation of the sheet 1-A, the conveyance motor 205 is driven to start rotation of the conveyance roller 5. The conveyance roller 5 conveys the sheet at 15 inches/sec. The sheet 1-A is aligned with the position facing the printhead 7. At this time, the surface of the sheet 1-A facing the printhead 7 is the second surface. The printing operation of the second surface of the aligned sheet 1-A is performed by discharging ink from the printhead 7 based on the printing data.

Figure 13:
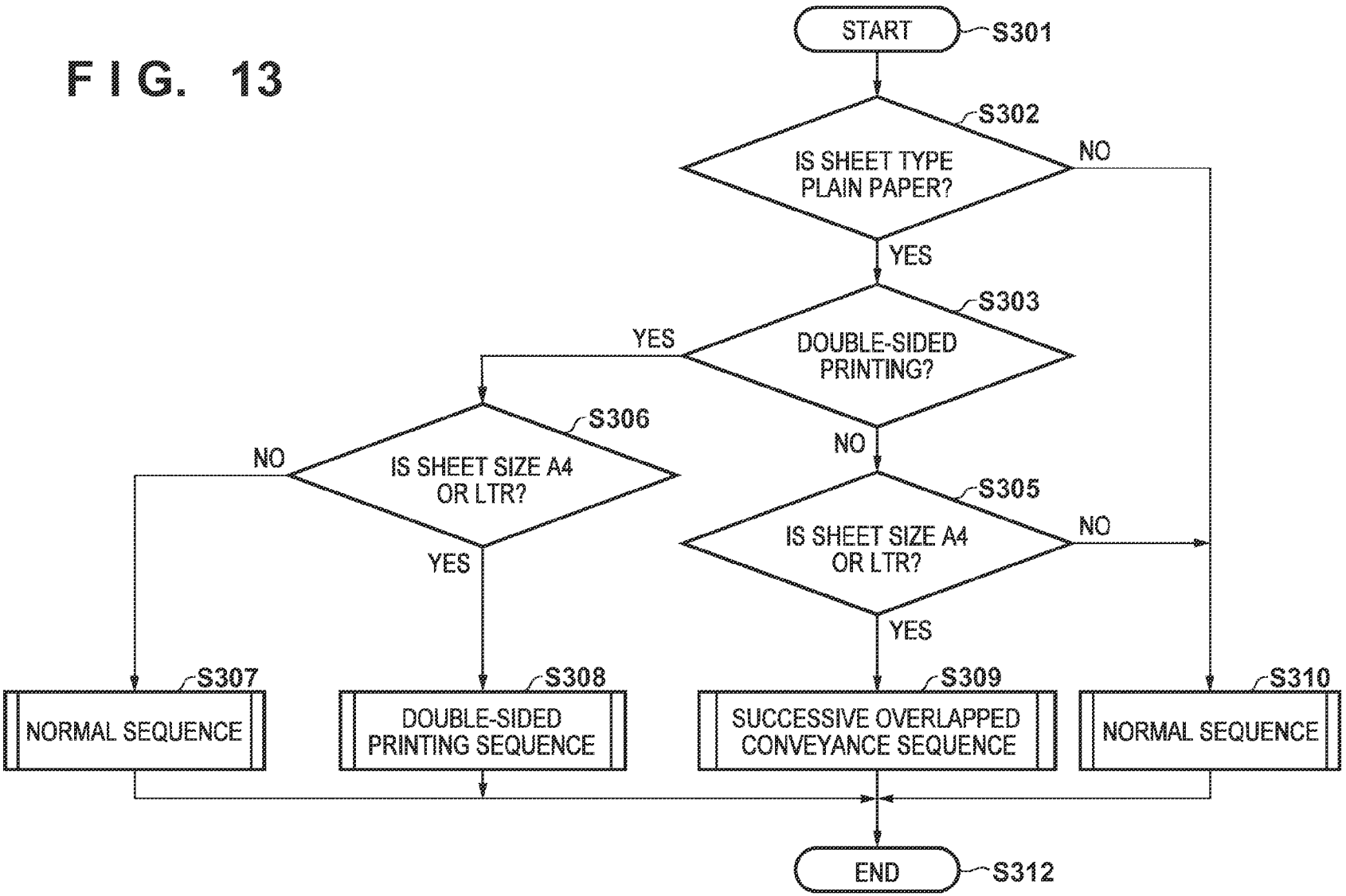
FIG. 13 is a flowchart for explaining feeding sequence selection processing according to the embodiment.

FIG. 13 is a flowchart for explaining feeding sequence selection processing according to the embodiment, which is executed under the control of the MPU 201. In step S301, when the host computer 214 transmits the sheet information and printing data of the printing sheet 1 via the I/F unit 213, a printing operation starts. The MPU 201 selects a feeding sequence of the printing sheet 1 based on the sheet information of the printing sheet 1 acquired from the host computer 214. In step S302, the MPU 201 confirms the sheet type of the printing sheet 1. If it is determined in step S302 that the sheet type is not plain paper (NO in step S302), the process advances to step S310, and a normal sequence is selected as a feeding sequence.

If it is determined in step S302 that the sheet type is plain paper (YES in step S302), the process advances to step S303, and the MPU 201 determines based on the printing data whether to perform double-sided printing. If double-sided printing is to be performed (YES in step S303), the process advances to step S306, and the MPU 201 confirms a sheet size. In this embodiment, the A4 size (a sheet length of 297 mm) and LTR size (a sheet length of 279.4 mm) are to undergo double-sided printing. Note that the sheet type to undergo double-sided printing is not limited to them, and various settings can be made.

If it is determined in step S306 that the sheet size is the A4 size or LTR size (YES in step S306), the process advances to step S308, and a double-sided printing sequence is selected as a feeding sequence. On the other hand, it is determined in step S306 that the sheet size is neither the A4 size nor the LTR size (NO in step S306), the process advances to step S307, and the normal sequence is selected as a feeding sequence.

If it is determined in step S303 not to perform double-sided printing (NO in step S303), the process advances to step S305. In step S305, the MPU 201 confirms the sheet size. In this embodiment, the A4 size and LTR size are to undergo successive overlapped conveyance. If the sheet size is the A4 size or LETTER size (YES in step S305), the process advances to step S309, and a successive overlapped conveyance sequence is selected as a feeding sequence. In the successive overlapped conveyance sequence of continuously printing on the first surfaces of a plurality of printing sheets, the MPU 201 controls to form the overlap state in which the leading edge of the succeeding sheet overlaps the trailing edge of the preceding sheet.

On the other hand, it is determined in step S305 that the sheet size is neither the A4 size nor the LTR size (NO in step S305), the process advances to step S310, and the normal sequence is selected as a feeding sequence. In the double-sided printing sequence or normal sequence of performing double-sided printing on the first and second surfaces of the printing sheet, the MPU 201 does not control to form the overlap state. The feeding sequence selection processing then ends.

Figure 14A:
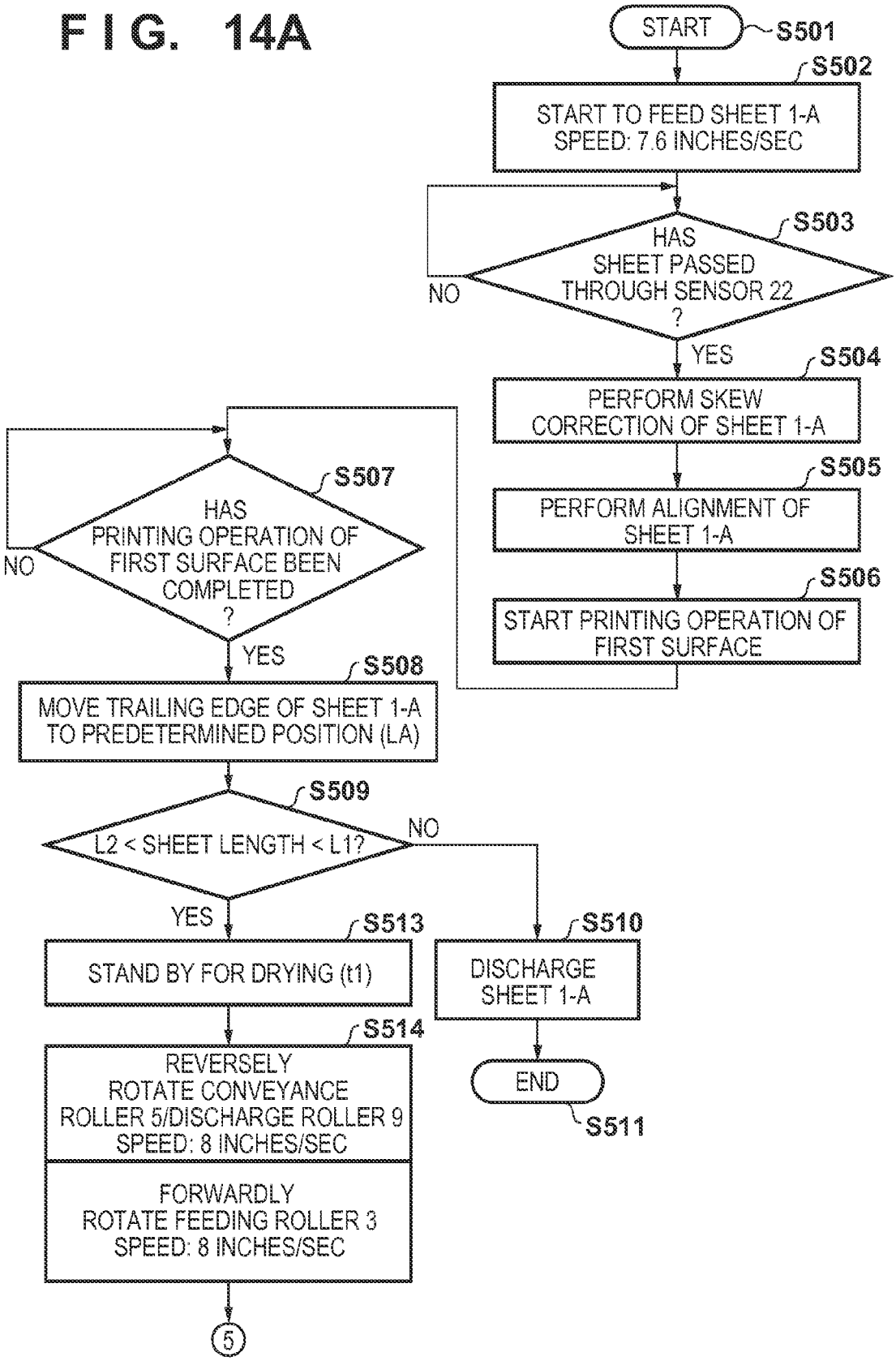
FIGS. 14A and 14B are flowcharts illustrating a double-sided printing sequence according to the embodiment.
Figure 14B:
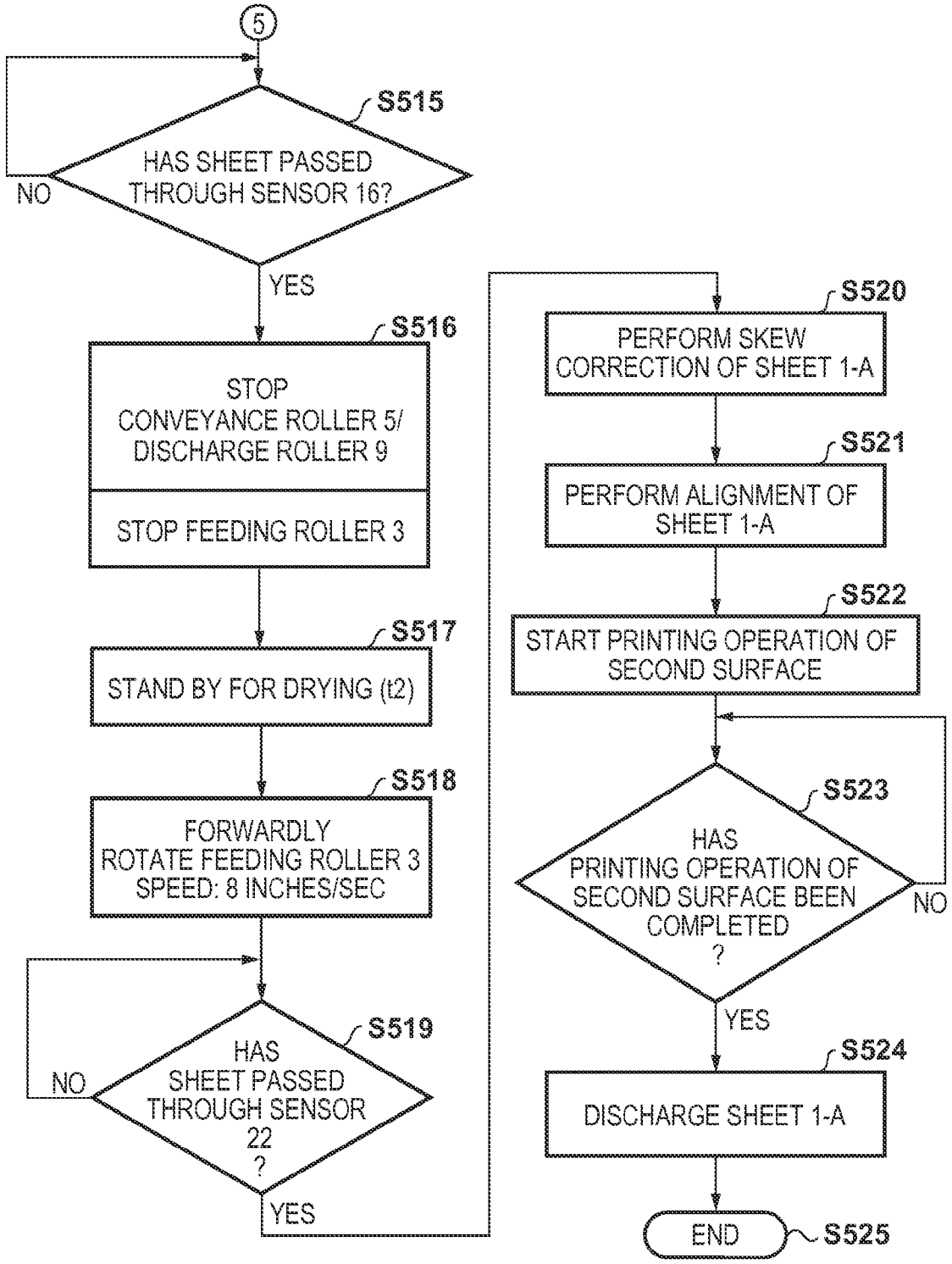

FIGS. 14A and 14B are flowcharts for explaining the double-sided printing sequence executed under the control of the MPU 201. In step S501, a printing operation by the double-sided printing sequence starts. To print on the first surface of the sheet, the feeding operation of the sheet 1-A starts in step S502. The feeding motor 206 is driven to rotate the pickup roller 2 at 7.6 inches/sec. The pickup roller 2 picks up the sheet 1-A, and the feeding roller 3 feeds the sheet 1-A toward the printhead 7.

In step S503, the sheet detection sensor 22 (second sheet detection sensor) detects the leading edge of the sheet 1-A. After the sheet detection sensor 22 detects the leading edge of the sheet 1-A (YES in step S503), controlling the rotation amount of the feeding roller 3 makes the leading edge of the sheet 1-A abut against the conveyance nip portion to perform the skew correction operation of the sheet 1-A in step S504.

In step S505, alignment of the sheet 1-A is performed based on the printing data. That is, by controlling the rotation amount of the conveyance roller 5, the sheet 1-A is conveyed to a printing start position with reference to the position of the conveyance roller 5 based on the printing data.

In step S506, a printing operation starts when the printhead 7 discharges ink to the first surface of the sheet 1-A. More specifically, the printing operation of the first surface of the sheet 1-A is performed by repeating a conveyance operation of intermittently conveying the sheet 1-A by the conveyance roller 5 and an image forming operation (ink discharge operation) of discharging ink from the printhead 7 by moving the carriage 10.

Upon completion of the printing operation of the first surface of the sheet 1-A in step S507 (YES in step S507), the MPU 201 advances the process to step S508. In step S508, the discharge roller 9 is rotated until the trailing edge of the sheet 1-A is set at a predetermined position (a position the distance LA away from the conveyance nip portion in ST11 of FIG. 11).

In step S509, the MPU 201 confirms the sheet length of the sheet 1-A, and confirms whether the sheet length corresponds to the A4 size or LTR size. With respect to a sheet set to undergo double-sided printing, L1 represents the upper limit of the sheet length, and L2 represents the lower limit of the sheet length. The sheet length of the sheet 1-A to undergo printing can be calculated based on the driving amount of the conveyance roller 5 from when the sheet detection sensor 22 (second sheet detection sensor) detects the leading edge of the sheet 1-A until the sheet detection sensor 22 detects the trailing edge of the sheet 1-A.

If it is determined in step S509 that the sheet length of the sheet 1-A to undergo printing does not satisfy a relationship "L1<sheet length<L2" (NO in step S509), that is, if the sheet length does not correspond to the A4 size or LTR size, the process advances to step S510. In step S510, the MPU 201 discharges the sheet 1-A, thereby terminating the printing operation (step S511).

If it is determined in step S509 that the sheet length of the sheet 1-A to undergo printing satisfies the relationship "L1<sheet length<L2", that is, if the sheet length corresponds to the A4 size or LTR size (YES in step S509), the process advances to step S513. In step S513, the MPU 201 stops rotation by the conveyance roller 5 and discharge roller 9 and stands by until ink discharged to the first surface of the sheet 1-A is dried. A standby time (t1) at this time is decided based on the type of ink, the overlapped ejection amount of ink, the ejection amount of ink per unit area, the environmental temperature, and the like.

In step S514, the MPU 201 reversely rotates the conveyance roller 5 and discharge roller 9 in a direction (the clockwise direction in ST12 of FIG. 11) opposite to that at the time of the printing operation, thereby causing one edge (the trailing edge at the time of printing the first surface) of the sheet 1-A to re-enter the conveyance nip portion. Furthermore, simultaneously with the start of the reverse rotation of the conveyance roller 5 and discharge roller 9, the MPU 201 also forwardly rotates the feeding roller 3 (the counterclockwise direction in ST12 of FIG. 11). At this time, the conveyance roller 5 rotates at 8 inches/sec, and the feeding roller 3 also rotates at 8 inches/sec. When each roller is continuously rotated, one edge of the sheet 1-A enters the feeding nip portion of the feeding roller 3 and feeding driven roller 4.

When the sheet detection sensor 16 detects one edge of the sheet 1-A in step S515, the conveyance roller 5, discharge roller 9, and feeding roller 3 stop rotating in step S516. In step S517, a drying standby time (t2) is provided. This operation need not be performed if the MPU 201 has performed the drying standby operation for the standby time (t1) in step S513. In this case, the process may transit to the next step by setting t2=0. When, for example, a sufficient marginal portion where no ink is discharged exists in the trailing edge of the sheet 1-A, the drying standby operation for the standby time (t2) is required. In this case, a drying time is allocated before the ink discharged to the first surface of the sheet 1-A reaches the conveyance nip portion, thereby preventing the ink from being transferred to the pinch roller 6. However, when the sheet 1-A is conveyed from the feeding nip portion by pushing the flapper 20 away, a paper jam may occur at high probability depending on the water content of the sheet 1-A. To cope with this, the drying standby operation for the appropriate standby time (t2) is performed so that drying increases the rigidity of the sheet 1-A and the sheet 1-A can pass through the flapper 20 and conveyance guide 15.

In step S518, the feeding roller 3 is forwardly rotated (in the counterclockwise direction in FIG. 12) at 8 inches/sec, thereby feeding the sheet 1-A toward the printhead 7. In step S519, the sheet detection sensor 22 (second sheet detection sensor) detects one edge of the sheet 1-A. After the sheet detection sensor 22 (second sheet detection sensor) detects one edge of the sheet 1-A (YES in step S519), the MPU 201 advances the process to step S520. By controlling the rotation amount of the feeding roller 3, one edge of the sheet 1-A is made to abut against the conveyance nip portion to perform the skew correction operation of the sheet 1-A in step S520.

In step S521, alignment of the sheet 1-A is performed based on the printing data. That is, by controlling the rotation amount of the conveyance roller 5, the sheet 1-A is conveyed to a printing start position with reference to the position of the conveyance roller 5 based on the printing data.

In step S522, a printing operation starts when the printhead 7 discharges ink to the second surface of the sheet 1-A. More specifically, the printing operation of the second surface of the sheet 1-A is performed by repeating a conveyance operation of intermittently conveying the sheet 1-A by the conveyance roller 5 and an image forming operation (ink discharge operation) of discharging ink from the printhead 7 by moving the carriage 10. Upon completion of the printing operation of the second surface of the sheet 1-A in step S523 (YES in step S523), the sheet 1-A is discharged in step S524, and the double-sided printing operation ends (step S525).

Figure 15A:
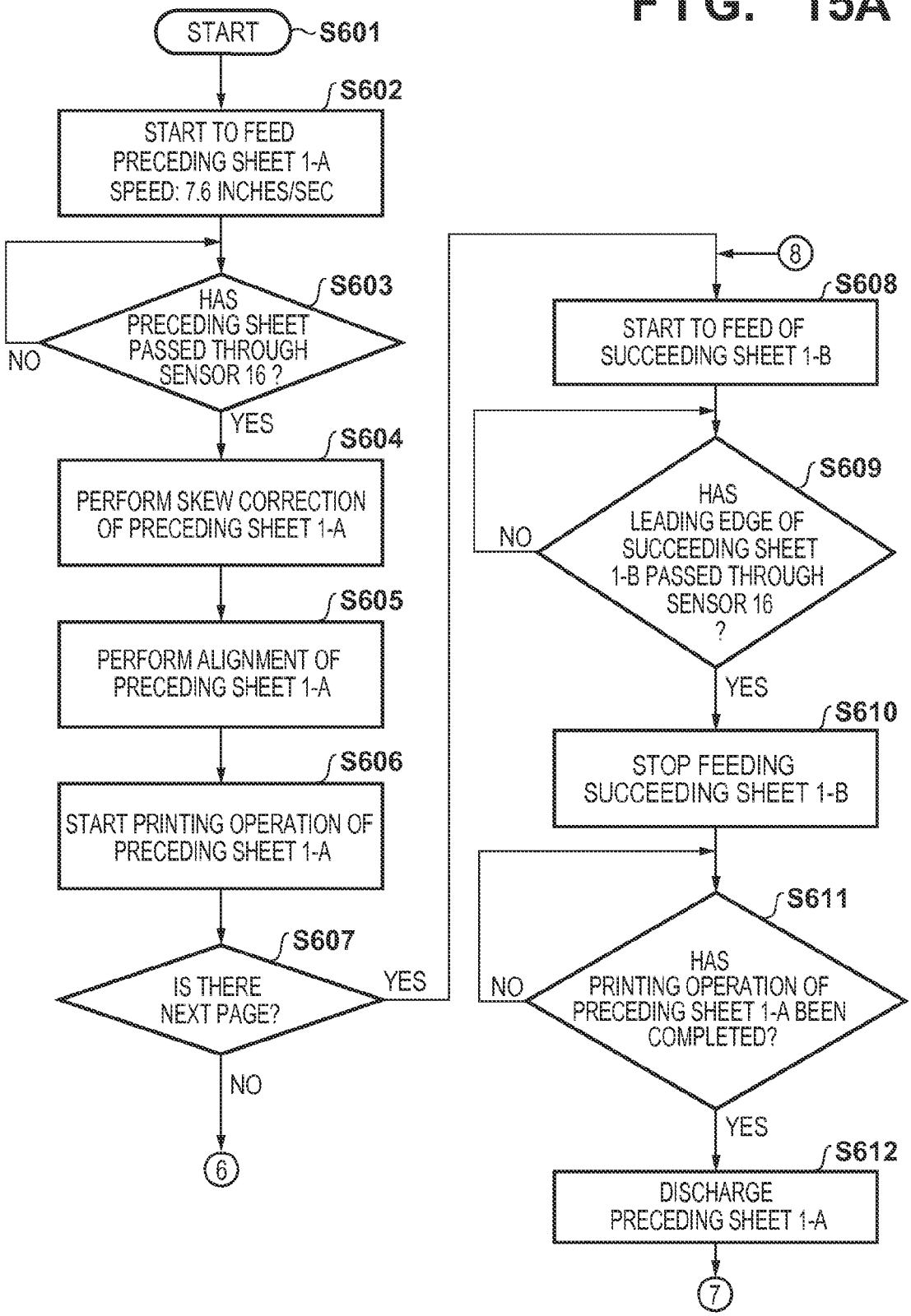
FIGS. 15A and 15B are flowcharts illustrating a normal sequence according to the embodiment.
Figure 15B:
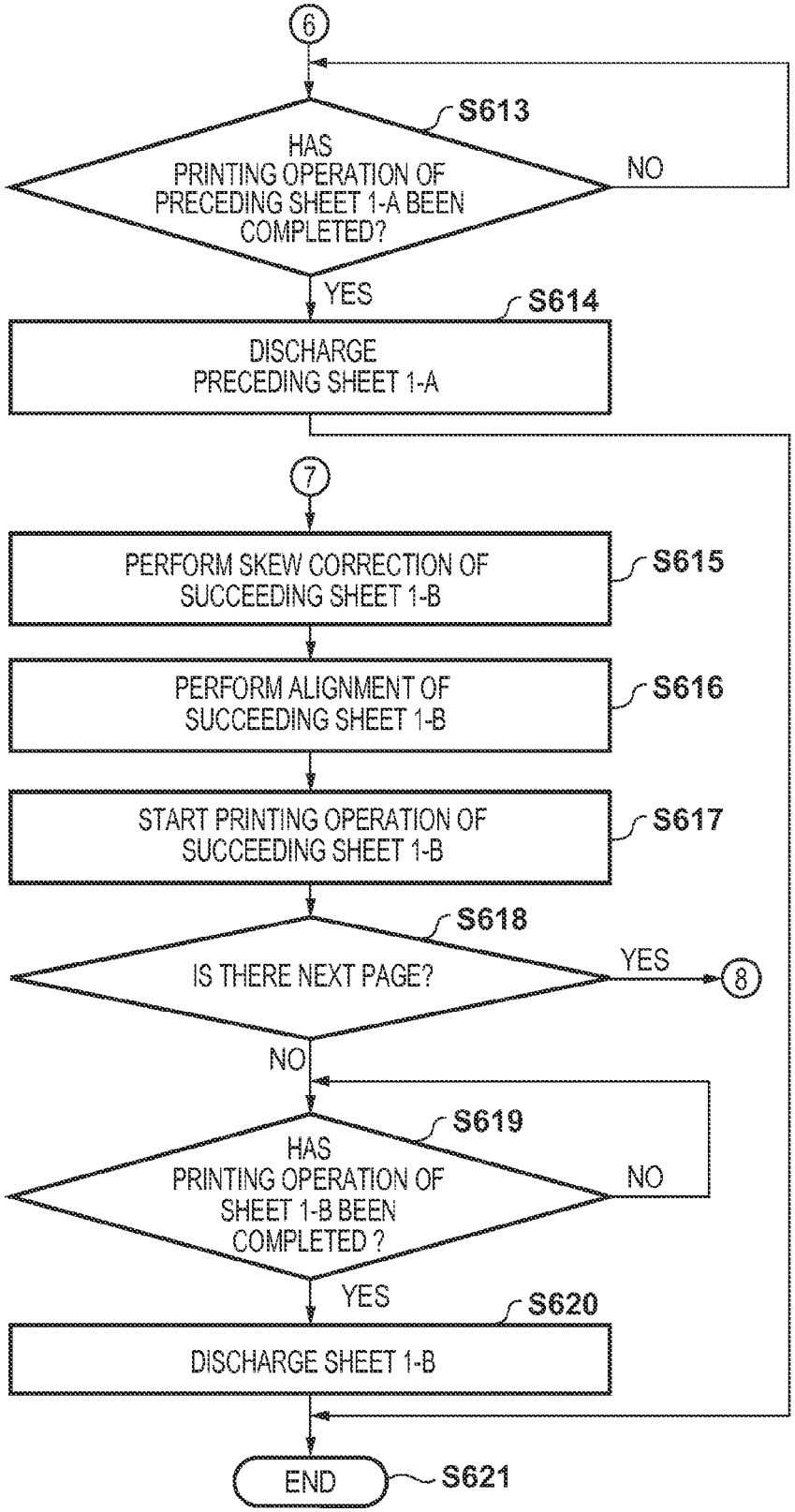

FIGS. 15A and 15B are flowcharts for explaining the normal sequence executed under the control of the MPU 201. In step S601, a printing operation by the normal sequence starts. In step S602, the feeding motor 206 is driven at low speed to rotate the pickup roller 2 at 7.6 inches/sec. The pickup roller 2 picks up the preceding sheet 1-A, and the feeding roller 3 feeds the preceding sheet 1-A toward the printhead 7. In step S603, the sheet detection sensor 16 detects the leading edge of the preceding sheet 1-A. After the sheet detection sensor 16 detects the leading edge of the preceding sheet 1-A (YES in step S603), controlling the rotation amount of the feeding roller 3 makes the leading edge of the preceding sheet 1-A abut against the conveyance nip portion to perform the skew correction operation of the preceding sheet 1-A in step S604.

In step S605, alignment of the preceding sheet 1-A is performed based on the printing data. That is, the preceding sheet 1-A is conveyed to a printing start position with reference to the position of the conveyance roller 5 based on the printing data by controlling the rotation amount of the conveyance roller 5.

In step S606, a printing operation starts when the printhead 7 discharges ink to the preceding sheet 1-A. More specifically, the printing operation of the preceding sheet 1-A is performed by repeating a conveyance operation of intermittently conveying the preceding sheet 1-A by the conveyance roller 5 and an image forming operation (ink discharge operation) of discharging ink from the printhead 7 by moving the carriage 10. The feeding motor 206 is intermittently driven at low speed in synchronization with the operation of intermittently conveying the preceding sheet 1-A by the conveyance roller 5. That is, the pickup roller 2 and feeding roller 3 intermittently rotate at 7.6 inches/sec.

In step S607, it is determined whether there is printing data of the next page. If there is no printing data of the next page (NO in step S607), the process advances to step S613. Upon completion of the printing operation of the preceding sheet 1-A in step S613 (YES in step S613), the preceding sheet 1-A is discharged in step S614, thereby terminating the printing operation (step S621).

If the determination processing in step S607 determines that there is printing data of the next page (YES in step S607), the feeding operation of the succeeding sheet 1-B starts in step S608. More specifically, the feeding motor 206 is driven at low speed to cause the pickup roller 2 to pick up the succeeding sheet 1-B and cause the feeding roller 3 to feed the succeeding sheet 1-B toward the printhead 7. The pickup roller 2 rotates at 7.6 inches/sec. As described above, since the large concave portion 2*c* of the pickup roller 2 is provided with respect to the projection 19*a* of the driving shaft 19, the succeeding sheet 1-B is fed while having a predetermined interval with respect to the trailing edge of the preceding sheet 1-A.

In step S609, the sheet detection sensor 16 detects the leading edge of the succeeding sheet 1-B. After the sheet detection sensor 16 detects the leading edge of the succeeding sheet 1-B (YES in step S609), the MPU 201 advances the process to step S610. In step S610, by controlling the rotation amount of the feeding roller 3, the succeeding sheet 1-B is conveyed so that its leading edge is at a position a predetermined amount after the conveyance nip portion, thereby stopping feeding the succeeding sheet 1-B. The preceding sheet 1-A is intermittently conveyed based on the printing data, and undergoes a printing operation.

Upon completion of the printing operation of the preceding sheet 1-A in step S611 (YES in step S611), the preceding sheet 1-A is discharged in step S612. Furthermore, by controlling the rotation amount of the feeding roller 3, the leading edge of the succeeding sheet 1-B is made to abut against the conveyance nip portion to perform the skew correction operation of the succeeding sheet 1-B in step S615.

In step S616, alignment of the succeeding sheet 1-B is performed based on the printing data. That is, by controlling the rotation amount of the conveyance roller 5, the succeeding sheet 1-B is conveyed to a printing start position with reference to the position of the conveyance roller 5 based on the printing data. In step S617, a printing operation starts when the printhead 7 discharges ink to the succeeding sheet 1-B. The printing operation of the succeeding sheet 1-B is the same as that of the preceding sheet 1-A, as described in step S606.

In step S618, it is determined whether there is printing data of the next page. If there is printing data of the next page (YES in step S618), the process returns to the processing in step S608 to repeat the same processing. If the determination processing in step S618 determines that there is no printing data of the next page (NO in step S618), the process advances to step S619. Upon completion of the printing operation of the succeeding sheet 1-B in step S619 (YES in step S619), the succeeding sheet 1-B is discharged in step S620, thereby terminating the printing operation (step S621).

Figure 6A:
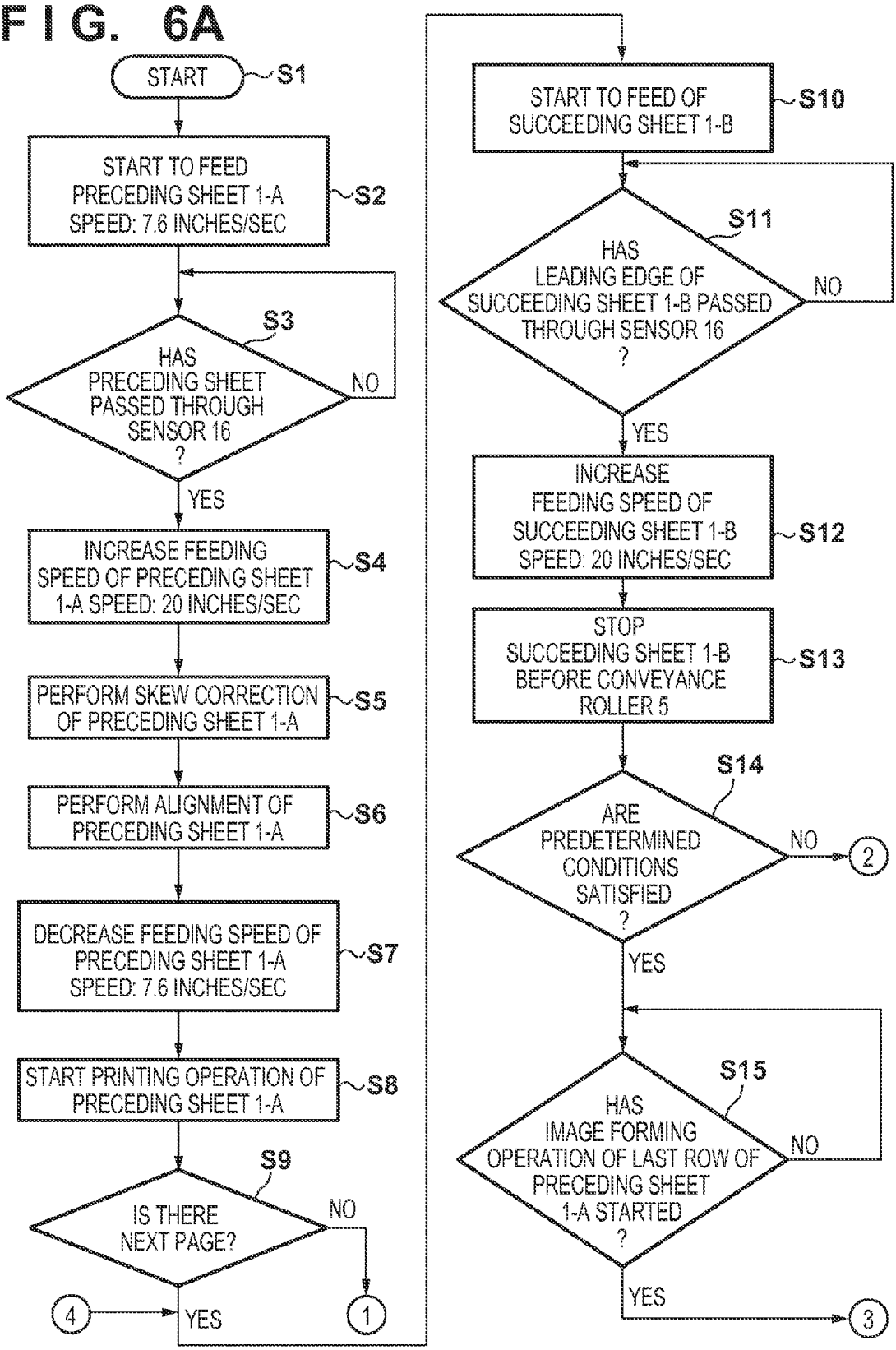
FIGS. 6A and 6B are flowcharts illustrating a successive overlapped conveyance sequence according to the embodiment.
Figure 6B:
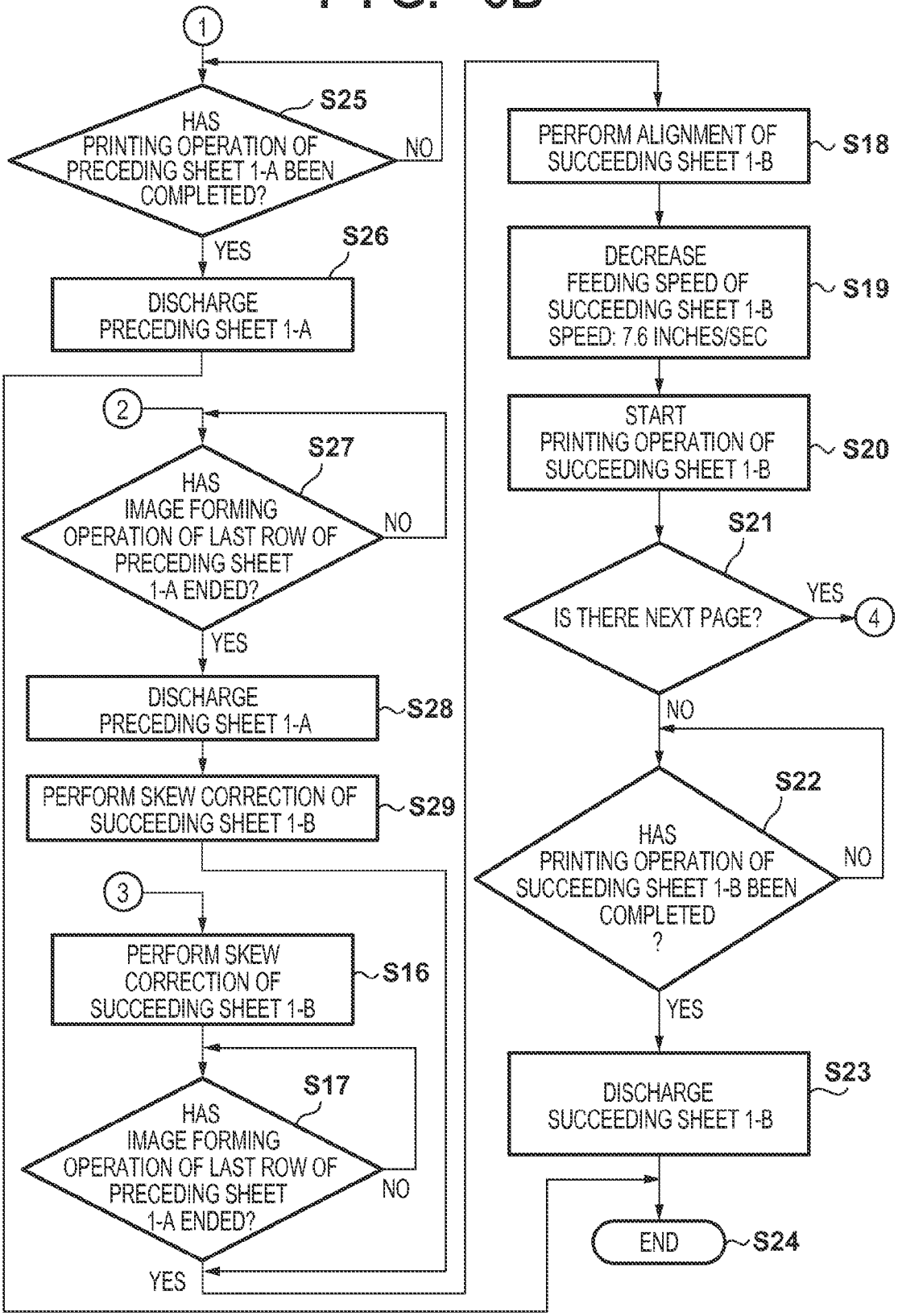

FIGS. 6A and 6B are flowcharts illustrating the successive overlapped conveyance sequence in continuous printing of only the first surfaces. In step S1, when the host computer 214 transmits printing data via the I/F unit 213, a printing operation starts. In step S2, the feeding operation of the preceding sheet 1-A starts. More specifically, the feeding motor 206 is driven at low speed. The pickup roller 2 rotates at 7.6 inches/sec. The pickup roller 2 picks up the preceding sheet 1-A, and the feeding roller 3 feeds the preceding sheet 1-A toward the printhead 7.

In step S3, the sheet detection sensor 16 detects the leading edge of the preceding sheet 1-A. When the sheet detection sensor 16 detects the leading edge of the preceding sheet 1-A (YES in step S3), the feeding motor 206 is switched to high-speed driving in step S4. That is, the pickup roller 2 and feeding roller 3 rotate at 20 inches/sec. In step S5, by controlling the rotation amount of the feeding roller 3 after the sheet detection sensor 16 detects the leading edge of the preceding sheet 1-A, the leading edge of the preceding sheet 1-A is made to abut against the conveyance nip portion to perform the skew correction operation of the preceding sheet 1-A.

In step S6, alignment of the preceding sheet 1-A is performed based on the printing data. That is, the preceding sheet 1-A is conveyed to a printing start position with reference to the position of the conveyance roller 5 based on the printing data by controlling the rotation amount of the conveyance roller 5. In step S7, the feeding motor 206 is switched to low-speed driving. In step S8, a printing operation starts when the printhead 7 discharges ink to the preceding sheet 1-A. More specifically, the printing operation of the preceding sheet 1-A is performed by repeating a conveyance operation of intermittently conveying the preceding sheet 1-A by the conveyance roller 5 and an image forming operation (ink discharge operation) of discharging ink from the printhead 7 by moving the carriage 10. The feeding motor 206 is intermittently driven at low speed in synchronization with the operation of intermittently conveying the preceding sheet 1-A by the conveyance roller 5. That is, the pickup roller 2 and feeding roller 3 intermittently rotate at 7.6 inches/sec.

In step S9, it is determined whether there is printing data of the next page. If there is no printing data of the next page, the process advances to step S25. Upon completion of the printing operation of the preceding sheet 1-A in step S25, the preceding sheet 1-A is discharged in step S26, thereby terminating the printing operation.

If there is printing data of the next page, the feeding operation of the succeeding sheet 1-B starts in step S10. More specifically, the pickup roller 2 picks up the succeeding sheet 1-B, and the feeding roller 3 feeds the succeeding sheet 1-B toward the printhead 7. The pickup roller 2 rotates at 7.6 inches/sec. As described above, since the large concave portion 2*c* of the pickup roller 2 is provided with respect to the projection 19*a* of the driving shaft 19, the succeeding sheet 1-B is fed while having a predetermined interval with respect to the trailing edge of the preceding sheet 1-A.

In step S11, the sheet detection sensor 16 detects the leading edge of the succeeding sheet 1-B. When the sheet detection sensor 16 detects the leading edge of the succeeding sheet 1-B, the feeding motor 206 is switched to high-speed driving in step S12. That is, the pickup roller 2 and feeding roller 3 rotate at 20 inches/sec. In step S13, by controlling the rotation amount of the feeding roller 3 after the sheet detection sensor 16 detects the leading edge of the succeeding sheet 1-B, the succeeding sheet 1-B is conveyed so that its leading edge is at a position a predetermined amount before the conveyance nip portion. The preceding sheet 1-A is intermittently conveyed based on the printing data. Continuously driving the feeding motor 206 at high speed forms the overlap state in which the leading edge of the succeeding sheet 1-B overlaps the trailing edge of the preceding sheet 1-A.

In step S14, it is determined whether predetermined conditions (to be described later) are satisfied. If the predetermined conditions are satisfied, it is determined in step S15 whether the image forming operation of the preceding sheet 1-A has started. If it is determined that the image forming operation has started, the process advances to step S16; otherwise, the process stands by until the image forming operation starts. In step S16, the leading edge of the succeeding sheet 1-B is made to abut against the conveyance nip portion while keeping the overlap state, thereby performing the skew correction operation of the succeeding sheet 1-B. If it is determined in step S17 that the image forming operation of the last row of the preceding sheet 1-A has ended, in step S18 alignment of the succeeding sheet 1-B is performed while keeping the overlap state.

If it is determined in step S14 that the predetermined conditions are not satisfied, the overlap state is canceled to perform alignment of the succeeding sheet 1-B. More specifically, if it is determined in step S27 that the image forming operation of the last row of the preceding sheet 1-A has ended, the discharge operation of the preceding sheet 1-A is performed in step S28. During this operation, the feeding motor 206 is not driven, and thus the succeeding sheet 1-B stops while its leading edge is at the position the predetermined amount before the conveyance nip portion. Since the preceding sheet 1-A is discharged, the overlap state is canceled. In step S29, the leading edge of the succeeding sheet 1-B is made to abut against the conveyance nip portion to perform the skew correction operation of the succeeding sheet 1-B. In step S18, alignment of the succeeding sheet 1-B is performed.

In step S19, the feeding motor 206 is switched to low-speed driving. In step S20, a printing operation starts by discharging ink from the printhead 7 to the succeeding sheet 1-B. More specifically, the printing operation of the succeeding sheet 1-B is performed by repeating a conveyance operation of intermittently conveying the succeeding sheet 1-B by the conveyance roller 5 and an image forming operation (ink discharge operation) of discharging ink from the printhead 7 by moving the carriage 10. The feeding motor 206 is intermittently driven at low speed in synchronization with the operation of intermittently conveying the succeeding sheet 1-B by the conveyance roller 5. That is, the pickup roller 2 and feeding roller 3 intermittently rotate at 7.6 inches/sec.

In step S21, it is determined whether there is printing data of the next page. If there is printing data of the next page, the process returns to step S10. If there is no printing data of the next page, when the image forming operation of the succeeding sheet 1-B is complete in step S22, the discharge operation of the succeeding sheet 1-B is performed in step S23 and the printing operation ends in step S24.

Figure 7:
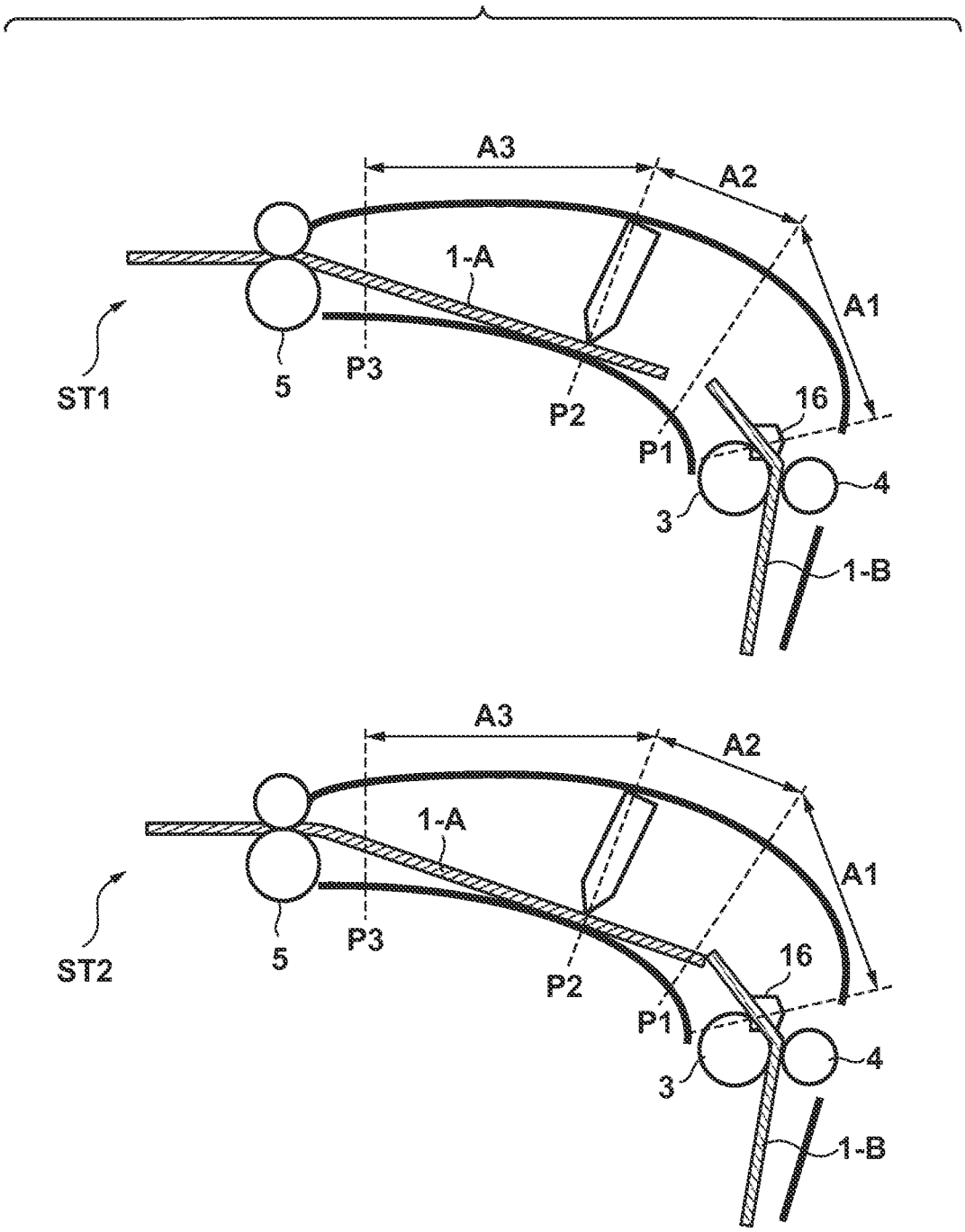
FIG. 7 is a view for explaining an operation of making a succeeding sheet overlap a preceding sheet.
Figure 8:
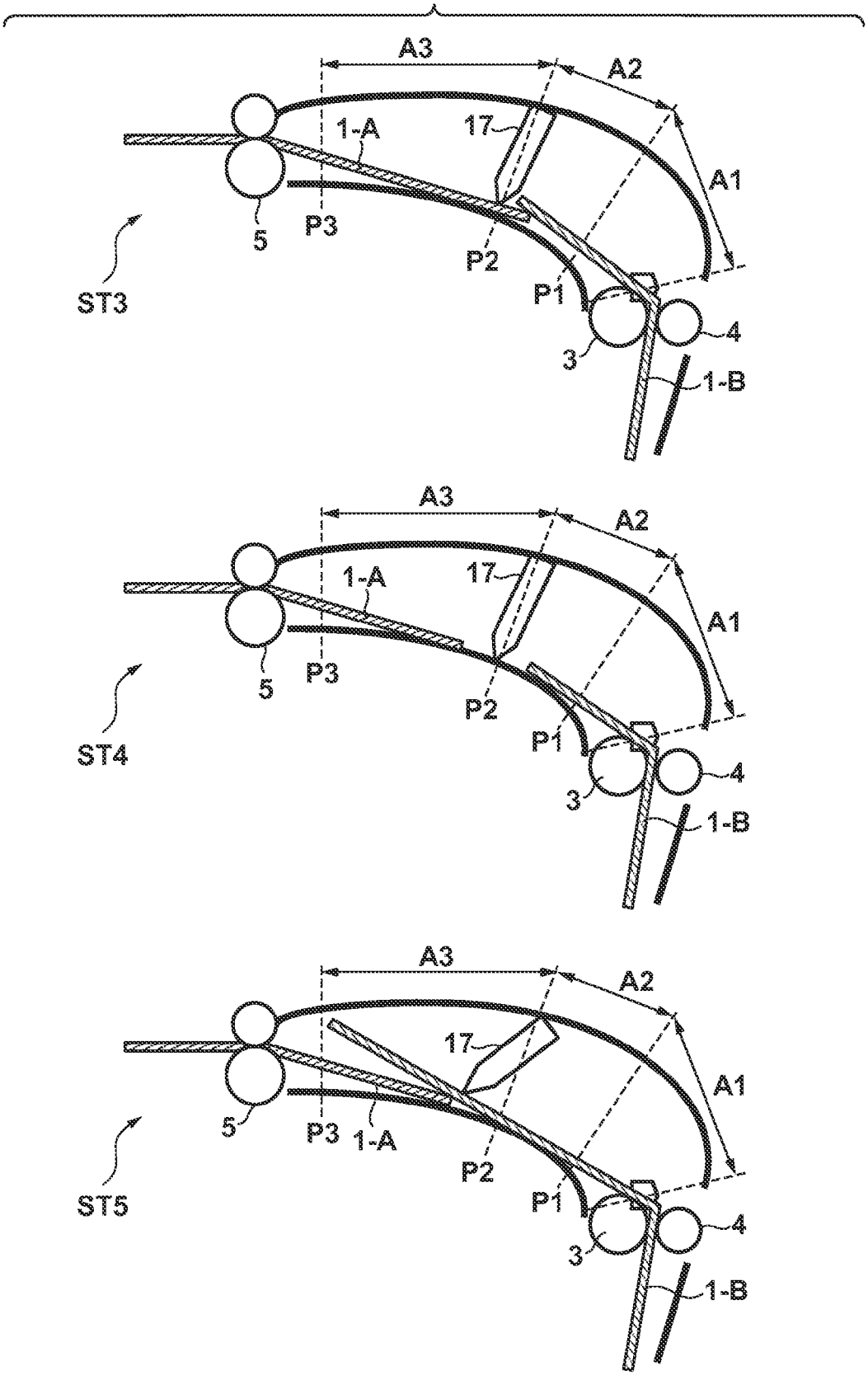
FIG. 8 is a view for explaining the operation of making the succeeding sheet overlap the preceding sheet.

FIGS. 7 and 8 are views for explaining an operation of making the succeeding sheet overlap the preceding sheet according to this embodiment. The operation of forming the overlap state in which the leading edge of the succeeding sheet overlaps the trailing edge of the preceding sheet, which has been explained in steps S12 and S13 of FIG. 6A, will be described.

FIGS. 7 and 8 are enlarged views each showing a portion between the feeding nip portion formed by the feeding roller 3 and feeding driven roller 4 and the conveyance nip portion formed by the conveyance roller 5 and pinch roller 6.

Three states in a process of conveying the printing sheets by the conveyance roller 5 and feeding roller 3 will be sequentially described. The first state in which an operation of making the succeeding sheet chase the preceding sheet is performed will be described with reference to ST1 and ST2 of FIG. 7. The second state in which an operation of making the succeeding sheet overlap the preceding sheet is performed will be described with reference to ST3 and ST4 of FIG. 8. The third state in which it is determined whether to perform the skew correction operation of the succeeding sheet while keeping the overlap state will be described with reference to ST5 of FIG. 8.

In ST1 of FIG. 7, the feeding roller 3 is controlled to convey the succeeding sheet 1-B, and the sheet detection sensor 16 detects the leading edge of the succeeding sheet 1-B. A section from the sheet detection sensor 16 to a position P1 at which the succeeding sheet 1-B can be made to overlap the preceding sheet 1-A is defined as a first section A1. In the first section A1, an operation of making the leading edge of the succeeding sheet 1-B chase the trailing edge of the preceding sheet 1-A is performed. The position P1 is decided based on the arrangement of the mechanism.

In the first state, the chasing operation may stop in the first section A1. If, as shown in ST2 of FIG. 7, the leading edge of the succeeding sheet 1-B passes the trailing edge of the preceding sheet 1-A before the position P1, the operation of making the succeeding sheet overlap the preceding sheet is not performed.

In ST3 of FIG. 8, a section from the above-described position P1 to a position P2 at which the sheet pressing lever 17 is provided is defined as a second section A2. In the second section A2, the operation of making the succeeding sheet 1-B overlap the preceding sheet 1-A is performed.

In the second state, the operation of making the succeeding sheet overlap the preceding sheet may stop in the second section A2. If, as shown in ST4 of FIG. 8, the leading edge of the succeeding sheet 1-B cannot catch up with the trailing edge of the preceding sheet 1-A within the second section A2, it is impossible to perform the operation of making the succeeding sheet overlap the preceding sheet.

In ST5 of FIG. 8, a section from the above-described position P2 to a position P3 is defined as a third section A3. The position P3 is the position of the leading edge of the succeeding sheet when the succeeding sheet stops in step S13 of FIG. 6A. While the succeeding sheet 1-B overlaps the preceding sheet 1-A, the succeeding sheet 1-B is conveyed so that its leading edge reaches the position P3. In the third section A3, it is determined whether to perform alignment of the succeeding sheet 1-B by making it abut against the conveyance nip portion while keeping the overlap state. That is, it is determined whether to perform alignment of the succeeding sheet by executing a skew correction operation while keeping the overlap state or to perform alignment of the succeeding sheet by canceling the overlap state and performing a skew correction operation.

Figure 9:
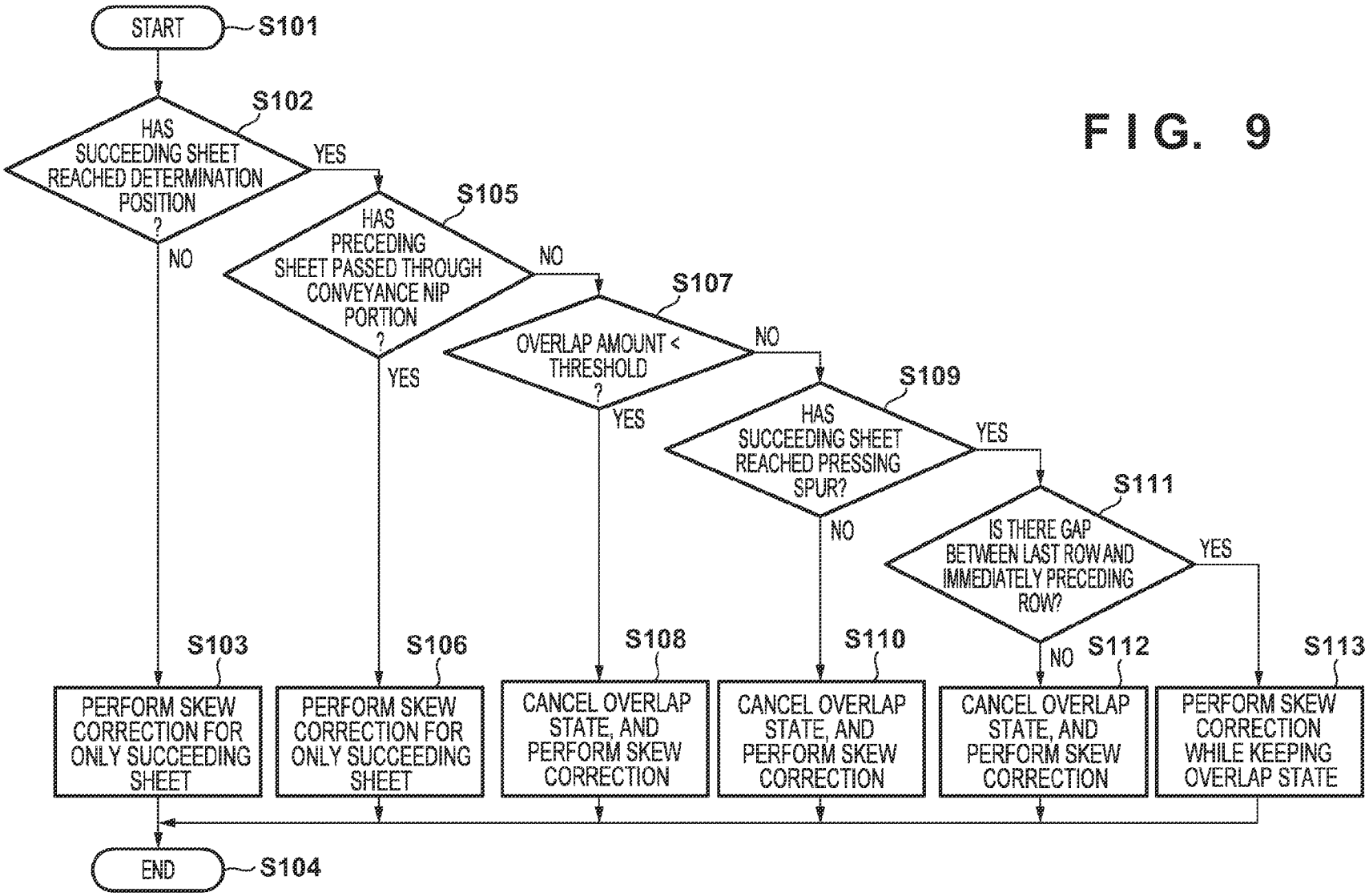
FIG. 9 is a flowchart for explaining the skew correction operation of the succeeding sheet according to the embodiment.

FIG. 9 is a flowchart for explaining the skew correction operation of the succeeding sheet according to this embodiment. The processing of determining whether the predetermined conditions are satisfied, which has been explained in step S14 of FIG. 6A, will be described in detail.

The operation of determining whether to perform a skew correction operation by making the leading edge of the succeeding sheet 1-B abut against the conveyance nip portion while keeping the overlap state between the preceding sheet 1-A and the succeeding sheet 1-B or to perform a skew correction operation by canceling the overlap state between the preceding sheet 1-A and the succeeding sheet 1-B and then making the leading edge of the succeeding sheet 1-B abut against the conveyance nip portion will be described.

In step S101, the operation starts. In step S102, it is determined whether the leading edge of the succeeding sheet 1-B has reached the determination position (the position P3 in ST5 of FIG. 8). If the leading edge of the succeeding sheet 1-B has not reached the determination position (NO in step S102), it is uncertain whether the leading edge of the succeeding sheet 1-B abuts against the conveyance nip portion by conveying the succeeding sheet 1-B by a predetermined amount, and thus a skew correction operation for only the succeeding sheet is decided (step S103), thereby terminating the determination operation (step S104). That is, after the trailing edge of the preceding sheet 1-A passes through the conveyance nip portion, only the succeeding sheet 1-B is made to abut against the conveyance nip portion to perform a skew correction operation, and then alignment of only the succeeding sheet 1-B is performed.

On the other hand, if it is determined that the leading edge of the succeeding sheet 1-B has reached the determination position P3 (YES in step S102), it is determined whether the trailing edge of the preceding sheet 1-A has passed through the conveyance nip portion (step S105). If it is determined that the trailing edge of the preceding sheet 1-A has passed through the conveyance nip portion (YES in step pS105), the succeeding sheet does not overlap the preceding sheet, and thus a skew correction operation for only the succeeding sheet is decided (step S106). That is, only the succeeding sheet 1-B is made to abut against the conveyance nip portion to perform a skew correction operation, and then alignment of only the succeeding sheet 1-B is performed.

On the other hand, if it is determined that the trailing edge of the preceding sheet 1-A has not passed through the conveyance nip portion (NO in step S105), it is determined whether the overlap amount of the trailing edge of the preceding sheet 1-A and the leading edge of the succeeding sheet 1-B is smaller than a threshold (step S107). The position of the trailing edge of the preceding sheet 1-A is updated along with the printing operation of the preceding sheet 1-A. The position of the leading edge of the succeeding sheet 1-B is at the above-described determination position. That is, the overlap amount decreases along with the printing operation of the preceding sheet 1-A. If it is determined that the overlap amount is smaller than the threshold (YES in step S107), the overlap state is canceled, and a skew correction operation for only the succeeding sheet is decided (step S108). That is, after the image forming operation of the preceding sheet 1-A ends, the succeeding sheet 1-B is not conveyed together with the preceding sheet 1-A. More specifically, the conveyance motor 205 drives the conveyance roller 5 to convey the preceding sheet 1-A. However, the feeding roller 3 is not driven. Therefore, the overlap state is canceled. Furthermore, only the succeeding sheet 1-B is made to abut against the conveyance nip portion to perform a skew correction operation, and then alignment of only the succeeding sheet 1-B is performed.

If it is determined that the overlap amount is equal to or larger than the threshold (NO in step S107), it is determined whether the succeeding sheet 1-B reaches the pressing spur 12 when alignment of the succeeding sheet 1-B is performed (step S109). If it is determined that the succeeding sheet 1-B does not reach the pressing spur 12 (NO in step S109), the overlap state is canceled and a skew correction operation for only the succeeding sheet is decided (step S110). That is, after the image forming operation of the preceding sheet 1-A ends, the succeeding sheet 1-B is not conveyed together with the preceding sheet 1-A. More specifically, the conveyance motor 205 drives the conveyance roller 5 to convey the preceding sheet 1-A. However, the feeding roller 3 is not driven. Consequently, the overlap state is canceled. Furthermore, only the succeeding sheet 1-B is made to abut against the conveyance nip portion to perform a skew correction operation, and then alignment of only the succeeding sheet 1-B is performed.

If it is determined that the succeeding sheet 1-B reaches the pressing spur 12 (YES in step S109), it is determined whether there is a gap between the last row of the preceding sheet and the row immediately preceding the last row (step S111). If it is determined that there is no gap (NO in step S111), the overlap state is canceled and a skew correction operation for only the succeeding sheet is decided (step S112). If it is determined that there is a gap (YES in step S111), the skew correction operation of the succeeding sheet 1-B is performed while keeping the overlap state, and alignment of the succeeding sheet 1-B is performed (Step S113). That is, during a period from when the image forming operation of the preceding sheet 1-A starts until the image forming operation ends, the succeeding sheet 1-B is made to abut against the conveyance nip portion while overlapping the preceding sheet 1-A. More specifically, the conveyance roller 5 and the feeding roller 3 are rotated by driving the feeding motor 206 together with the conveyance motor 205. After the skew correction operation, alignment of the succeeding sheet 1-B is performed while the succeeding sheet 1-B overlaps the preceding sheet 1-A.

As described above, the operation of determining whether to keep or cancel the overlap state between the preceding sheet 1-A and the succeeding sheet 1-B is performed.

Figure 10:
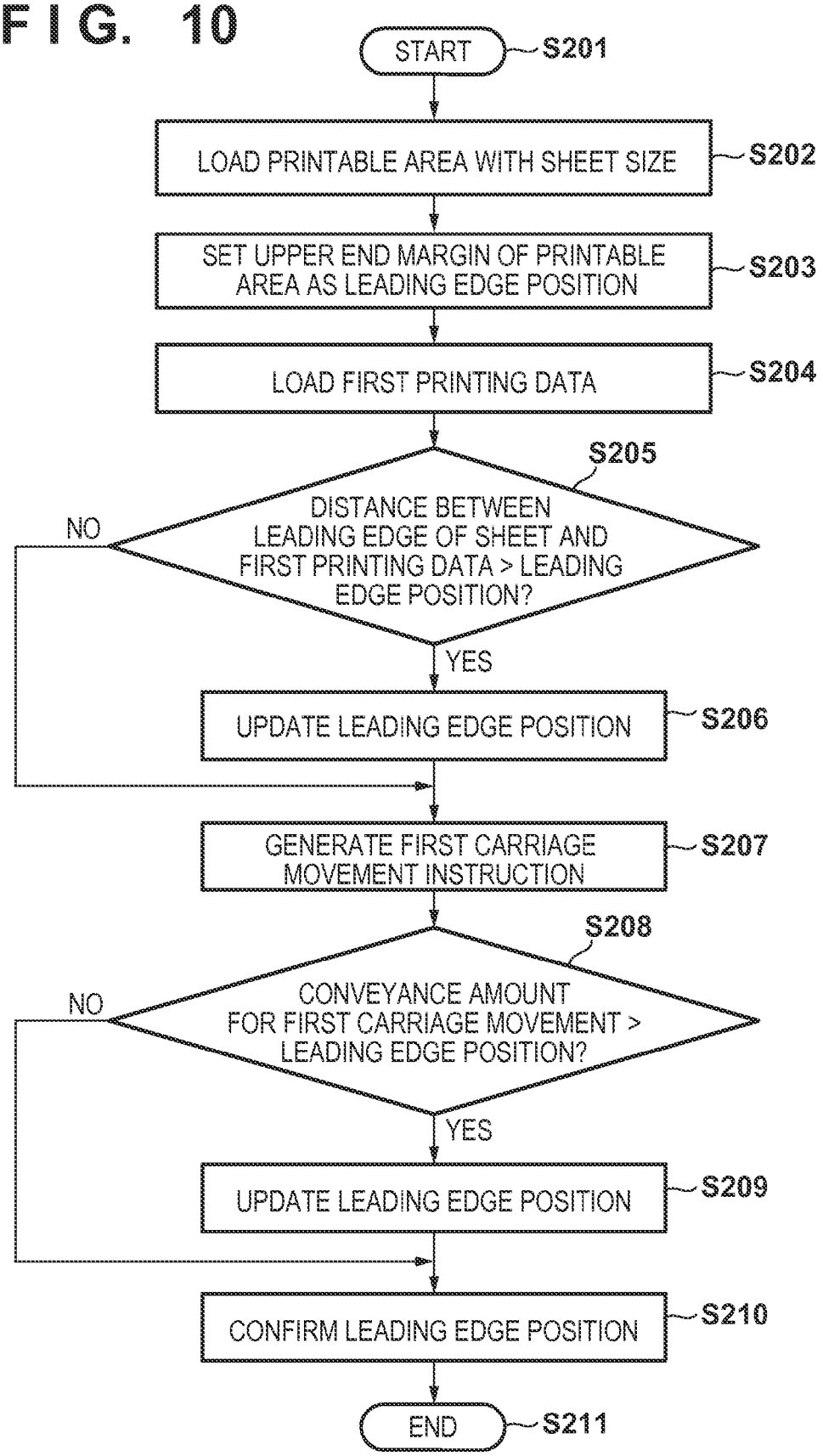
FIG. 10 is a flowchart for explaining an operation of calculating the leading edge position of the succeeding sheet.

FIG. 10 is a flowchart for explaining an arrangement of calculating the leading edge position of the succeeding sheet after alignment of the succeeding sheet according to this embodiment.

In step S201, the process starts. In step S202, a printable area with a sheet size is loaded. Since the uppermost printable position, that is, the upper end margin is specified, the upper end margin of the printable area is set as a leading edge position (step S203). Note that the leading edge position is defined by the distance from the conveyance nip portion.

The first printing data is loaded (step S204). With this processing, the position of the first printing data from the leading edge of the sheet is specified (detection of a non-printing area), and thus it is determined whether the distance between the leading edge of the sheet and the first printing data is larger than the previously set leading edge position (step S205). If the distance between the leading edge of the sheet and the first printing data is larger than the previously set leading edge position (YES in step S205), the leading edge position is updated by the distance between the leading edge of the sheet and the first printing data (step S206). If the distance between the leading edge of the sheet and the first printing data is equal to or smaller than the previously set leading edge position (NO in step S205), the process advances to step S207.

Next, the first carriage movement instruction is generated (step S207). It is determined whether a sheet conveyance amount for the first carriage movement is larger than the previously set leading edge position (step S208). If the sheet conveyance amount for the first carriage movement is larger than the previously set leading edge position (YES in step S208), the leading edge position is updated by the sheet conveyance amount for the first carriage movement (step S209). If the sheet conveyance amount for the first carriage movement is equal to or smaller than the previously set leading edge position (NO in step S208), the leading edge position is not updated. In this manner, the leading edge position of the succeeding sheet 1-B is confirmed (step S210), and the process ends (step S211). Based on the confirmed leading edge position, it is possible to determine (step S109 of FIG. 9) whether the succeeding sheet 1-B reaches the pressing spur 12 when performing alignment of the succeeding sheet B.

According to the above embodiment, when continuously printing on the first surfaces of a plurality of printing sheets, an overlap state in which the leading edge of the succeeding sheet overlaps the trailing edge of the preceding sheet is formed at the time of continuous printing of the first surfaces, and the printing sheets are conveyed while keeping the overlap state. This can increase the speed of a printing operation. Alternatively, when performing double-sided printing on the first and second surfaces of a printing sheet, a control operation of forming the overlap state is not performed. This can suppress a stain on the sheet, a paper jam, and degradation in image quality.

When performing the printing operation of the preceding sheet 1-A by the printhead 7, the feeding motor 206 is driven in synchronization with the conveyance motor 205 before the sheet detection sensor 16 detects the leading edge of the succeeding sheet 1-B, and the feeding motor 206 is continuously driven after the sheet detection sensor 16 detects the leading edge of the succeeding sheet, thereby making it possible to perform a chasing operation to make the succeeding sheet overlap the preceding sheet.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-116204, filed Jun. 4, 2014, which is hereby incorporated by reference herein in its entirety.

What is claimed is:

1. A printing apparatus comprising:

a feeding roller configured to feed a printing sheet;

a conveyance roller configured to convey the printing sheet fed by the feeding roller;

a printing unit configured to perform printing on a first surface and a second surface of the printing sheet conveyed by the conveyance roller;

a reverse conveyance guide configured to reverse the printing sheet having been printed on the first surface by the printing unit and convey the printing sheet to the conveyance roller;

a conveyance control unit configured to control conveyance of printing sheets so that an overlap state, in which a trailing edge of a preceding sheet as a printing sheet precedingly fed by the feeding roller and a leading edge of a succeeding sheet as a printing sheet succeedingly fed by the feeding roller overlap each other, is formed between the feeding roller and the conveyance roller, wherein when continuously performing printing on the first surface of the succeeding sheet after printing on the first surface of the preceding sheet, the conveyance control unit forms the overlap state, and when continuously performing printing on the first surface of the succeeding sheet after printing on the second surface of the preceding sheet, the conveyance control unit does not form the overlap state; and a determination unit configured to determine, in a case where the overlap state is formed, whether to convey the succeeding sheet to a position facing the printing unit while keeping the overlap state or to convey the succeeding sheet to the position after the overlap state has been cancelled.

2. The apparatus according to claim 1, wherein the reverse conveyance guide is configured to reverse the printing sheet from the first surface to the second surface, wherein when executing double-sided printing on a first surface and a second surface of the printing sheet, after a printing operation of the first surface of the printing sheet ends, the conveyance control unit conveys the printing sheet to the reverse conveyance guide in a reverse direction opposite to a conveyance direction at the time of the printing operation, the reverse conveyance guide reverses the printing sheet from the first surface to the second surface, and sets the second surface of the printing sheet as a printing surface, and the conveyance control unit conveys the printing sheet reversed by the reverse conveyance guide to the conveyance roller.

3. The apparatus according to claim 2, further comprising a sheet pressing unit configured to press the trailing edge of the preceding sheet downward when performing an operation of making the leading edge of the succeeding sheet overlap the trailing edge of the preceding sheet, wherein the sheet pressing unit is configured to be rotatable while the sheet pressing unit is in contact with the printing sheet when the printing sheet is conveyed in the reverse direction.

4. The apparatus according to claim 2, further comprising a sheet pressing unit configured to press the trailing edge of the preceding sheet downward when performing an operation of making the leading edge of the succeeding sheet overlap the trailing edge of the preceding sheet, wherein the sheet pressing unit is arranged at a position which does not contact the printing sheet when the printing sheet is conveyed in the reverse direction.

5. The apparatus according to claim 2, further comprising a sheet pressing unit configured to press the trailing edge of the preceding sheet downward when performing an operation of making the leading edge of the succeeding sheet overlap the trailing edge of the preceding sheet, wherein when the printing sheet is conveyed in the reverse direction, the leading edge of the printing sheet whose first surface is set as a printing surface passes through the sheet pressing unit and then the leading edge of the printing sheet whose second surface is set as a printing surface by the reverse conveyance guide passes through the sheet pressing unit.

6. A control method for a printing apparatus including a feeding roller configured to feed a printing sheet, a conveyance roller configured to convey the printing sheet fed by the feeding roller, a printing unit configured to perform printing on a first surface and a second surface of the printing sheet conveyed by the conveyance roller, and a reverse conveyance guide configured to reverse the printing sheet having been printed on the first surface by the printing unit and convey the printing sheet to the conveyance roller, the method comprising:

a conveyance control step of controlling conveyance of printing sheets so that an overlap state, in which a trailing edge of a preceding sheet as a printing sheet precedingly fed by the feeding roller and a leading edge of a succeeding sheet as a printing sheet succeedingly fed by the feeding roller overlap each other, is formed between the feeding roller and the conveyance roller, wherein when continuously performing printing on the first surface of the succeeding sheet after printing on the first surface of the preceding sheet, the conveyance control step forms the overlap state, and when continuously performing printing on the first surface of the succeeding sheet after printing on the second surface of the preceding sheet, the conveyance control step does not form the overlap state; and a determination step of determining, in a case where the overlap state is formed, whether to convey the succeeding sheet to a position facing the printing unit while keeping the overlap state or to convey the succeeding sheet to the position after the overlap state has been cancelled.

7. A non-transitory computer-readable storage medium storing a program for causing a computer to execute a step of a control method for a printing apparatus including a feeding roller configured to feed a printing sheet, a conveyance roller configured to convey the printing sheet fed by the feeding roller, a printing unit configured to perform printing on a first surface and a second surface of the printing sheet conveyed by the conveying roller, and a reverse conveyance guide configured to reverse the printing sheet having been printed on the first surface by the printing unit and convey the printing sheet to the conveyance roller, the method comprising:

a conveyance control step of controlling conveyance of printing sheets so that an overlap state, in which a trailing edge of a preceding sheet as a printing sheet precedingly fed by the feeding roller and a leading edge of a succeeding sheet as a printing sheet succeedingly fed by the feeding roller overlap each other, is formed between the feeding roller and the conveyance roller, wherein when continuously performing printing on the first surface of the succeeding sheet after printing on the first surface of the preceding sheet, the conveyance control step forms the overlap state, and when continuously performing printing on the first surface of the succeeding sheet after printing on the second surface of the preceding sheet, the conveyance control step does not form the overlap state; and a determination step of determining, in a case where the overlap state is formed, whether to convey the succeeding sheet to a position facing the printing unit while keeping the overlap state or to convey the succeeding sheet to the position after the overlap state has been cancelled.

* * * * *